US010618317B2

(12) United States Patent
Katagami

(10) Patent No.: US 10,618,317 B2
(45) Date of Patent: Apr. 14, 2020

(54) PRINTING APPARATUS AND PRINTING METHOD OF PRINTING APPARATUS

(71) Applicant: SEIKO EPSON CORPORATION, Tokyo (JP)

(72) Inventor: Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 107 days.

(21) Appl. No.: 15/893,053

(22) Filed: Feb. 9, 2018

(65) Prior Publication Data

US 2018/0229512 A1 Aug. 16, 2018

(30) Foreign Application Priority Data

Feb. 16, 2017 (JP) ..... 2017-026670

(51) Int. Cl.

| | |
|---|---|
| ***F26B 3/00*** | (2006.01) |
| ***B41J 11/00*** | (2006.01) |
| ***B41J 2/01*** | (2006.01) |
| ***B41J 15/04*** | (2006.01) |

(52) U.S. Cl.

CPC ..... *B41J 11/002* (2013.01); *B41J 2/01* (2013.01); *B41J 15/04* (2013.01); *B41J 15/046* (2013.01)

(58) Field of Classification Search

CPC ... B41J 11/002; B41J 2/01; B41J 2/375; B41J 15/046; B41J 15/04; B41J 13/0009; B41J 13/0018; B41J 13/0027; B41J 13/0036; B41J 23/02; B41J 23/025; B41J 23/10; B41J 25/10; B41J 29/17; B41J 29/58; B41J 11/009; B41J 11/485; F26B 3/02; F26B 3/06

USPC ..... 34/494, 495, 496, 444, 443, 509, 85

See application file for complete search history.

(56) References Cited

U.S. PATENT DOCUMENTS 5,920,330 A * 7/1999 Ikezaki ..... B41J 2/16535 347/17

2013/0162708 A1* 6/2013 Hanagami ..... B41J 2/072 347/10

FOREIGN PATENT DOCUMENTS

JP 2005-001303 1/2005

* cited by examiner

*Primary Examiner* — John P McCormack

(74) *Attorney, Agent, or Firm* — Workman Nydegger

(57) ABSTRACT

A printing apparatus includes a drying unit, and has, a first mode in which a temperature of the drying unit is decreased by performing a control of electric connection to a heater of the drying unit or a temperature control of the heater after starting the maintenance work, and the temperature of the drying unit is increased by performing the control of electric connection to the heater or the temperature control of the heater after the maintenance work, and a second mode in which the temperature of the drying unit is decreased by performing the control of electric connection to the heater or the temperature control of the heater after the starting of the maintenance work, and the temperature of the drying unit is increased by performing the control of electric connection to the heater or the temperature control of the heater during the maintenance work.

12 Claims, 7 Drawing Sheets

PRINTING APPARATUS AND PRINTING METHOD OF PRINTING APPARATUS

BACKGROUND

1. Technical Field

The present invention relates to a printing apparatus and a printing method of the printing apparatus.

2. Related Art

A printing apparatus which includes a drying device such as a heater in order to promote drying and fixing of ink ejected to a recording medium (medium) is known (for example, JP-A-2005-1303). The printing apparatus disclosed in JP-A-2005-1303 includes a heater as a drying device. In the printing apparatus, in order to prevent the medium from being excessively heated by the heater, while printing is stopped, the recording medium is separated from the heater, and the heater is stopped.

However, in the printing apparatus disclosed in JP-A-2005-1303, there is a problem in that for separating the recording medium from the heater, an apparatus is increased in size and it is difficult to reduce costs or to make the apparatus compact. Further, in order to restart the printing, the heater is reheated from a state of being stopped, and thus it is necessary to hold printing until the heater is reheated up to a temperature for printing, and there is also another problem in that a printing efficiency is deteriorated.

SUMMARY

The invention can be realized in the following aspects or application examples.

APPLICATION EXAMPLE 1

According to this application example, there is provided a printing apparatus including a drying unit that dries a medium on which ink is applied, in which in a case in which printing is temporarily stopped and a predetermined interruption work is performed, the printing apparatus has a first mode in which a temperature of the drying unit is decreased by performing a control of electric connection to a heater of the drying unit or a temperature control of the heater after starting the interruption work, and the temperature of the drying unit is increased by performing the control of electric connection to the heater or the temperature control of the heater after the interruption work, and a second mode in which the temperature of the drying unit is decreased by performing the control of electric connection to the heater or the temperature control of the heater after the starting of the interruption work, and the temperature of the drying unit is increased by performing the control of electric connection to the heater or the temperature control of the heater during the interruption work.

In the first mode, in a case in which the interruption work is performed in a state in which the printing is temporarily stopped, since the temperature of the drying unit is decreased by performing a control of electric connection to the heater of the drying unit or a temperature control of the heater after the starting of the interruption work, and the temperature of the drying unit is increased by performing the control of electric connection to the heater or the temperature control of the heater after the interruption work, the temperature of the drying unit is decreased during the interruption work (during temporary stoppage of the printing), and a defect that the medium is excessively heated (thermal damage of medium) is not easily generated.

In the second mode, in a case in which the interruption work is performed in a state in which the printing is temporarily stopped, since the temperature of the drying unit is decreased by performing a control of electric connection to the heater of the drying unit or a temperature control of the heater after the starting of the interruption work, and the temperature of the drying unit is increased by performing the control of electric connection to the heater or the temperature control of the heater during the interruption work, the temperature of the drying unit is decreased during the interruption work (during temporary stoppage of the printing), and a defect that the medium is excessively heated (thermal damage of medium) is not easily generated.

In addition, in the first mode, the temperature of the drying unit is decreased during the interruption work further than in the second mode, and thus a defect that the medium is excessively heated (thermal damage of medium) becomes harder to be generated. Meanwhile, in the second mode, compared to the first mode, it is possible to quickly return the temperature of the drying unit after the interruption work to an original temperature (temperature at the time of printing) at which printing is possible, and thus the printing is enable to quickly restart.

Further, since a large device for separating the medium from the heater is not required, when compared to a case in which the large device for separating the medium from the heater is required, a configuration of the printing apparatus is simplified, and cost reduction and compactness are easily achieved.

APPLICATION EXAMPLE 2

In the printing apparatus according to the application example, it is preferable that the printing apparatus have a determination work for determining whether or not to perform a first interruption work which is the same as the interruption work or a second interruption work which is different from the interruption work after the interruption work.

When the printing apparatus is not recovered to the normal state due to the interruption work, the determination work for determining whether or not the first interruption work which is the same as the interruption work or the second interruption work which is different from the interruption work is performed is performed, and the first interruption work or the second interruption work is further performed after the interruption work, and thus the printing apparatus is easily recovered to the normal state.

APPLICATION EXAMPLE 3

In the printing apparatus according to the application example, it is preferable that, in the second mode, the control of electric connection to the heater or the temperature control of the heater be performed so that the temperature of the drying unit becomes a temperature before the starting of the interruption work when the determination work is finished.

When the control of electric connection to the heater or the temperature control of the heater is performed so that the temperature of the drying unit becomes a temperature (temperature at the time of printing) before starting the interruption work after finishing the determination work, it is possible to quickly return the temperature of the drying unit at the time of finishing of the determination work to an original temperature (temperature at the time of printing) at which printing is possible, and thus the printing is enable to quickly restart.

APPLICATION EXAMPLE 4

In the printing apparatus according to the application example, it is preferable that, in the first mode, the control of electric connection to a heater or the temperature control of the heater be performed so that the temperature of the drying unit reaches a standby temperature which is lower than the temperature at the time of starting the interruption work after starting the interruption work, and the control of electric connection to the heater or the temperature control of the heater be performed so that the standby temperature is maintained until the determination work is finished after the temperature reaches the standby temperature.

In a case in which the printing is temporarily stopped and after the interruption work starts, the temperature of the drying unit is decreased so that the temperature of the drying unit becomes the standby temperature lower than a temperature (temperature at the time of printing) at the time of starting the interruption work, and further, after the temperature reaches the standby temperature, when the temperature of the drying unit is maintained at the standby temperature until the determination work is finished, the temperature of the drying unit is lower than the temperature at the time of printing during the interruption work (during temporary stoppage printing), and thus a defect (thermal damage of medium) that the medium is excessively heated does not easily occur.

Further, since the temperature of the drying unit is increased from the standby temperature so that the printing restarts, when compared to a case in which the temperature of the drying unit is increased so that the printing restarts from a state in which the heater is stopped (a state in which the electric connection to the heater is stopped), the temperature of the drying unit is quickly increased to the original temperature (temperature at the time of printing) at which printing is possible, and a standby time until the temperature of the drying unit is increased is further reduced, and thereby making it possible to improve a printing efficiency.

APPLICATION EXAMPLE 5

In the printing apparatus according to the application example, it is preferable that the standby temperature be varied depending on the types of the medium.

When the standby temperature can be varied depending on the types of the medium, for example, since a thermal damage is not easily generated in the medium in which the thermal damage is not easily generated even when the standby temperature is increased, as compared to a medium in which the thermal damage is easily generated, the standby temperature is increased, the temperature of the drying unit is quickly increased higher than the original temperature (temperature at the time of printing) at which printing is possible, and a standby time until the temperature of the drying unit is increased is further reduced, and thereby making it possible to improve a printing efficiency. For example, when the standby temperature is decreased in the medium in which the thermal damage is easily generated, compared to the medium in which the thermal damage is not easily generated, the defect (thermal damage of medium) that the medium is excessively heated does not easily occur during the interruption work (during temporary stoppage of the printing), even in the medium in which the thermal damage is easily generated.

APPLICATION EXAMPLE 6

In the printing apparatus according to the application example, it is preferable that, in a case in which the first interruption work or the second interruption work is further performed as a result of the determination work, in the first mode, the control of electric connection to the heater or the temperature control of the heater be performed so that the standby temperature is maintained, even during the first interruption work or the second interruption work, and the temperature of the drying unit be increased by performing a control of electric connection to the heater or a temperature control of the heater after the first interruption work or the second interruption work is finished.

In a case in which the first interruption work or the second interruption work is further performed after the interruption work, since the temperature of the drying unit is maintained at the standby temperature which is lower than the temperature at the time of starting the interruption work (temperature at the time of printing) until the first interruption work or the second interruption work is finished, a defect (thermal damage of medium) that the medium is excessively heated during the interruption work (during temporary stoppage of the printing) is not easily generated.

APPLICATION EXAMPLE 7

In the printing apparatus according to the application example, it is preferable that the first interruption work or the second interruption work be repeatedly performed a plurality of times, and the temperature of the drying unit be increased by performing the control of electric connection to the heater or the temperature control of the heater after the last first interruption work or the last second interruption work is finished.

Since the temperature of the drying unit is maintained at the standby temperature which is lower than the temperature (temperature at the time of printing) at the time of starting the interruption work until the last first interruption work or the last second interruption work is finished, a defect (thermal damage of medium) that the medium is excessively heated during the interruption work (during temporary stoppage of the printing) is not easily generated.

APPLICATION EXAMPLE 8

In the printing apparatus according to the application example, it is preferable that, in a case in which the first interruption work or the second interruption work is further performed as a result of the determination work, in the second mode, the temperature of the drying unit be decreased by performing a control of electric connection to the heater or a temperature control of the heater after the determination work, and the temperature of the drying unit be increased by performing a control of electric connection to the heater or a temperature control of the heater during the first interruption work or the second interruption work.

In a case in which the first interruption work or the second interruption work is further performed after the interruption work, when the temperature of the drying unit is increased during the first interruption work or the second interruption work, compared to a case in which the temperature of the drying unit is increased after finishing the first interruption work or the second interruption work, it is possible to quickly return the temperature of the drying unit to an original temperature (temperature at the time of printing) at which printing is possible, and thus the printing is enable to quickly restart.

APPLICATION EXAMPLE 9

In the printing apparatus according to the application example, it is preferable that the first interruption work or the second interruption work be repeatedly performed a plurality of times, and the control of electric connection to the heater or the temperature control of the heater be performed so that the temperature of the drying unit becomes a predetermined temperature when the last first interruption work is finished or the last second interruption work is finished.

At the time of the finishing of the last first interruption work or the finishing of the last second interruption work, when the control of electric connection to the heater or the temperature control of the heater is performed so that the temperature of the drying unit becomes a predetermined temperature (temperature at the time of printing), compared to a case in which the control of electric connection to the heater or the temperature control of the heater is performed after the last the first interruption work or the last second interruption work is finished, the temperature of the drying unit is quickly increased to the original temperature (temperature at the time of printing) at which printing is possible, and the standby time until the temperature of the drying unit is increased is further reduced, and thereby making it possible to improve a printing efficiency.

APPLICATION EXAMPLE 10

In the printing apparatus according to the application example, it is preferable that a receiving unit that receives selection of the first mode or selection of the second mode be further included.

When the receiving unit receives selection of the first mode or selection of the second mode depending on the types of the medium, a reliability or a printing efficiency of the printing apparatus can be improved.

In detail, in the first mode, since the temperature of the drying unit is decreased after the starting of the interruption work, and the temperature of the drying unit is increased after the interruption work, compared to the second mode, the temperature of the drying unit at the time of the interruption work is decreased, a defect (thermal damage of medium) that the medium is excessively heated during the interruption work is not easily generated, and thereby making it possible to improve a reliability of the printing apparatus. Therefore, it is preferable that a thermal damage with respect to the medium be suppressed in the medium in which a thermal damage is easily generated by the first mode.

In the second mode, since the temperature of the drying unit is decreased after the starting of the interruption work, and the temperature of the drying unit is increased during the interruption work, compared to the first mode, the temperature of the drying unit is quickly returned to the original temperature (temperature at the time of printing) at which printing is possible, the printing quickly restarts, and thus thereby making it possible to improve a printing efficiency of the printing apparatus. Therefore, it is preferable that the printing quickly restart on the medium in which a thermal damage is not easily generated by the second mode.

APPLICATION EXAMPLE 11

In the printing apparatus according to the application example, it is preferable that whether or not the first mode is selected or the second mode is selected be determined depending on the types of the medium.

When a configuration of determining whether or not the first mode is selected or the second mode is selected depending on the types of the medium is included, a reliability or a printing efficiency of the printing apparatus can be improved.

In detail, in the first mode, since the temperature of the drying unit is decreased after the starting of the interruption work, the temperature of the drying unit is increased after the interruption work, compared to the second mode, the temperature of the drying unit is decreased at the time of the interruption work, a defect that the medium is excessively heated (thermal damage of medium) is not easily generated during the interruption work, thereby making it possible to improve a reliability of the printing apparatus. Therefore, it is preferable that a thermal damage with respect to the medium be suppressed in the medium in which a thermal damage is easily generated by the first mode.

In the second mode, since the temperature of the drying unit is decreased after the starting of the interruption work, the temperature of the drying unit is increased during the interruption work, compared to the first mode, the temperature of the drying unit is quickly returned to the original temperature (temperature at the time of printing) at which printing is possible, the printing quickly restarts, and thereby making it possible to improve a printing efficiency of the printing apparatus. Therefore, it is preferable that the printing quickly restart on the medium in which a thermal damage is not easily generated by the second mode.

APPLICATION EXAMPLE 12

According to this application example, there is provided a printing method of a printing apparatus which includes a drying unit drying a medium on which ink is applied, the method including, in which in a case where printing is temporarily stopped and a predetermined interruption work is performed, increasing a temperature of the drying unit and restarting the printing by either of a first mode, in which a temperature of the drying unit is decreased by performing a control of electric connection to a heater the drying unit or a temperature control of the heater of after starting the interruption work and the temperature of the drying unit is increased by performing the control of electric connection to the heater or the temperature control of the heater after the interruption work, or a second mode in which the temperature of the drying unit is decreased by performing the control of electric connection to the heater or the temperature control of the heater after the starting of the interruption work, and the temperature of the drying unit is increased by performing the control of electric connection to the heater or the temperature control of the heater during the interruption work.

In a case in which the interruption work is performed in a state in which the printing is temporarily stopped, in the first mode in which the temperature of the drying unit is decreased after the starting of the interruption work, and the temperature of the drying unit is increased after the interruption work, the temperature of the drying unit is decreased during the interruption work, and thus a defect that the medium is excessively heated (thermal damage of medium) is not easily generated.

In a case in which the interruption work is performed in a state in which the printing is temporarily stopped, in the second mode in which the temperature of the drying unit is decreased after the starting of the interruption work, and the temperature of the drying unit is increased during the interruption work, compared to the first mode, the temperature of the drying unit is quickly returned to the original temperature (temperature at the time of printing) at which the printing is possible after the interruption work, and the printing is enable to quickly restart.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
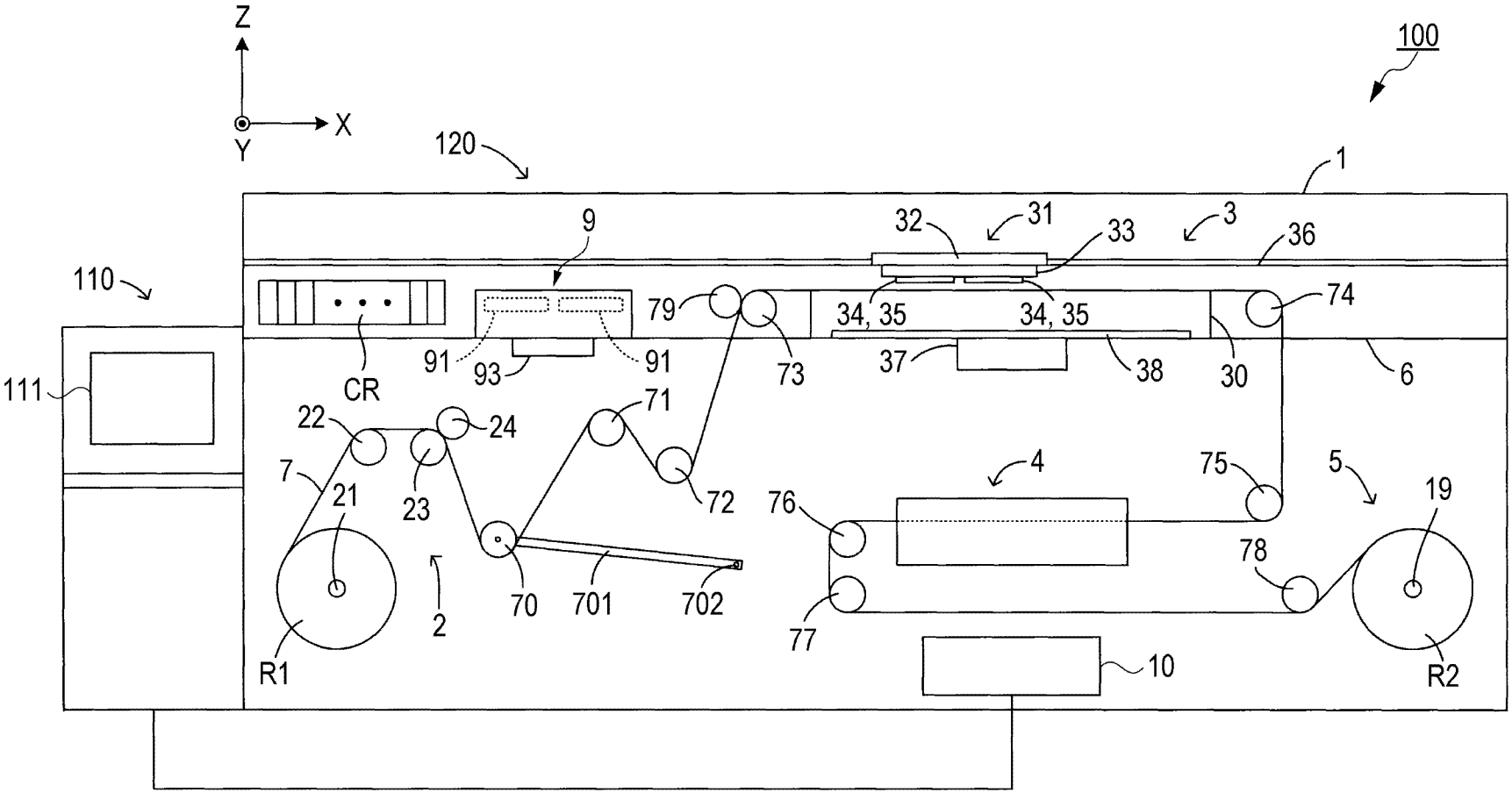
FIG. 1 is a schematic view illustrating an outline of a printing apparatus according to an embodiment.

Hereinafter, with reference to drawings, embodiments of the invention will be described. Such embodiments indicate aspects of the invention, and can be arbitrary modified within a scope of a technical idea of the invention without limiting the invention. In addition, in each drawing to be described later, in order to illustrate each layer and each part as a size to be recognizable in the drawings, the sizes of each layer or each part are different from the actual.

EMBODIMENT

Outline of Printing Apparatus

Figure 2:
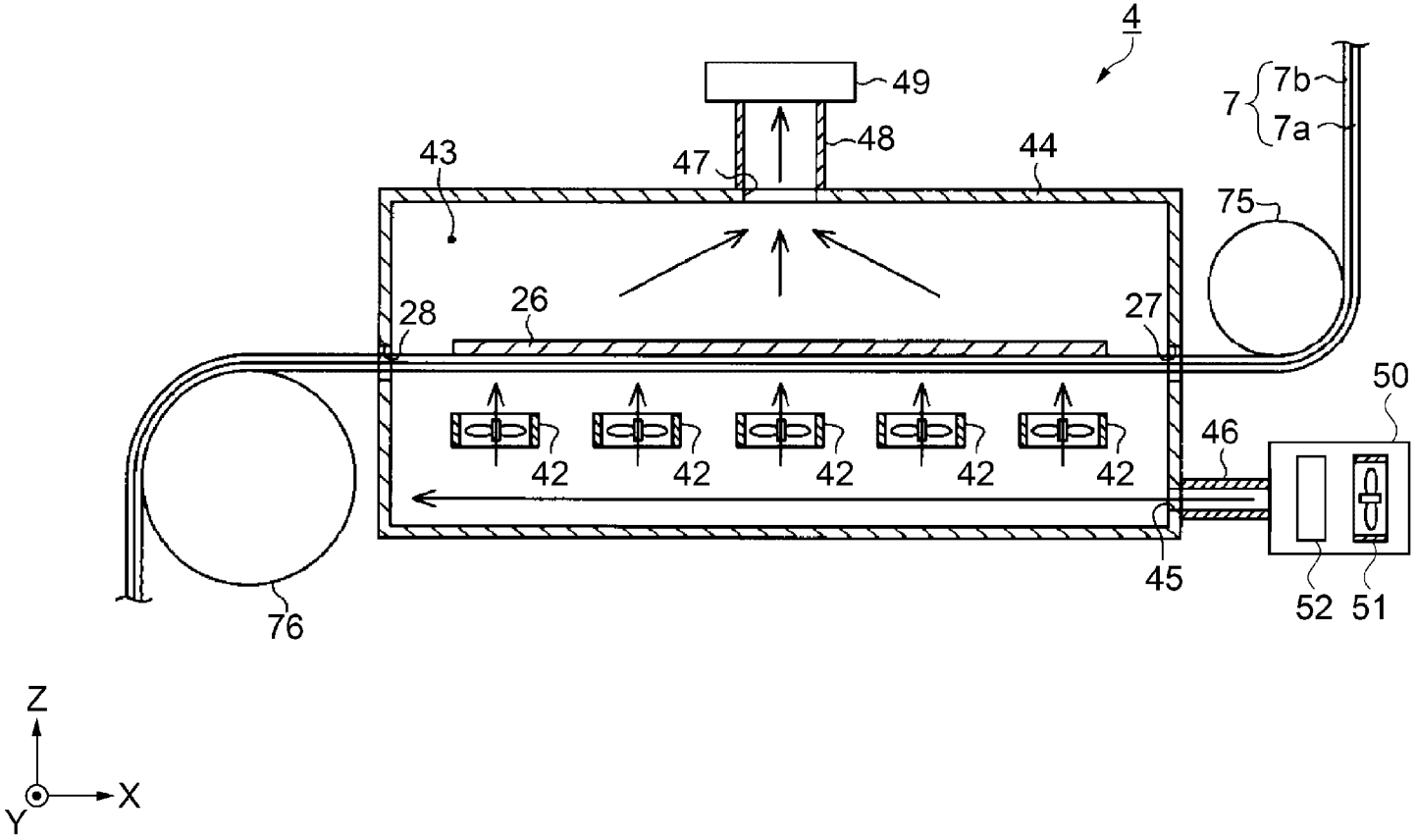
FIG. 2 is a schematic view illustrating an outline of a drying unit.
Figure 3:
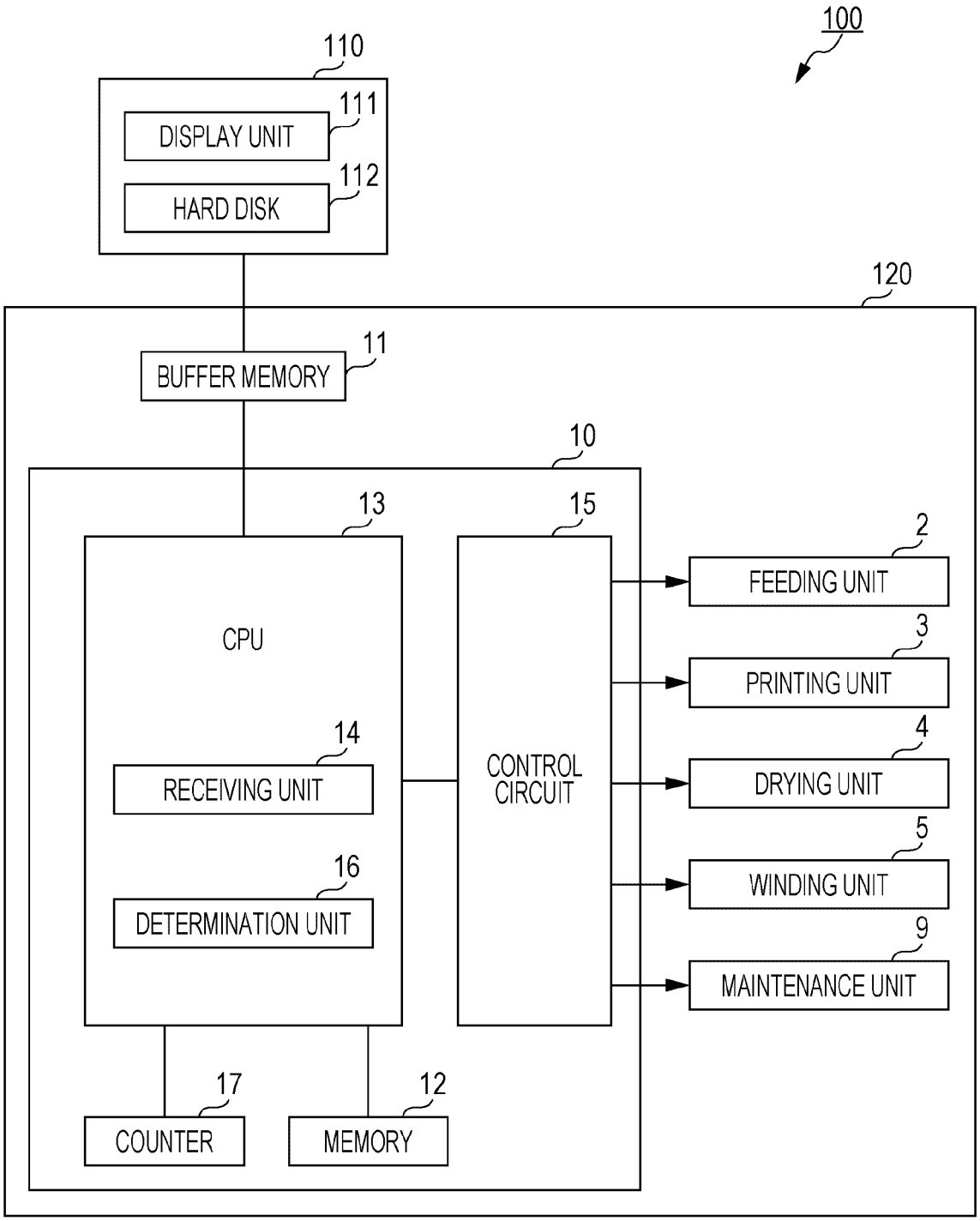
FIG. 3 is a control block diagram of the printing apparatus according to the embodiment.

FIG. 1 is a schematic view illustrating an outline of a printing apparatus according to an embodiment. FIG. 2 is a schematic view illustrating an outline of a drying unit. FIG. 3 is a control block diagram of the printing apparatus according to the embodiment.

First, with reference to FIGS. 1 to 3, an outline of a printing apparatus 100 according to the embodiment will be described.

As illustrated in FIG. 1, the printing apparatus 100 according to the embodiment is provided with a host device 110 which generates printing data based on image data received from an external device such as a personal computer, and a printing apparatus main body 120 which performs printing an image based on the printing data received from the host device 110.

The printing apparatus main body 120 feeds a long medium 7 wound in a roll shape and prints an image on the medium 7 in an ink jet method. The printing apparatus main body 120 is provided with a main body case 1 in a substantially rectangular shape.

In the main body case 1, a controller 10 which controls each unit of the printing apparatus main body 120, a feeding unit 2 which feeds the medium 7 unwound from a roll body R1 wound in a roll shape, a printing unit 3 which performs printing on the medium 7 fed from the feeding unit 2 by ejecting ink, a drying unit 4 which dries the medium 7 to which ink is attached, a winding unit 5 which winds the medium 7 after being dried as a roll body R2, and a maintenance unit 9 are disposed.

In description hereinafter, a longitudinal direction of the main body case 1 is set as an X direction, a short-length direction of the main body case 1 is set as a Y direction, and a height direction of the main body case 1 is set as a Z direction. In addition, a direction (distal end side of arrow) where an arrow indicating a direction face is set as a (+) direction, and a direction (base end side of arrow) opposite thereto is set as a (−) direction. In addition, the X direction is an X (+) direction, the Y direction is a Y (+) direction, the Z direction is a Z (+) direction, and each (+) direction may be referred to as a direction without (+).

The main body case 1 is divided into an upper part and a lower part in the Z direction by a flat base 6 disposed in parallel to an XY plane (that is, horizontal plane), and an upper side of the base 6 is the printing unit 3. A platen 30 is fixed to an upper surface of the base 6 in a substantial center inside the printing unit 3. The platen 30 has a rectangular shape, and supports the medium 7 from a lower side by an upper surface parallel to the XY plane. Also, a recording unit 31 performs printing on the medium 7 supported on the platen 30.

Meanwhile, the feeding unit 2, the drying unit 4, and the winding unit 5 are disposed on a lower side of the base 6. The feeding unit 2 is disposed on a lower side of the platen 30 in an X (−) direction (obliquely left lower side of FIG. 1), and is provided with a holding shaft 21 which is rotatable and holds the roll body R1 around which the medium 7 is wound. Further, the feeding unit 2 is provided with a roller 22 and a feeding roller 23 which are arranged in the X direction on an upper side of the holding shaft 21. Also, the medium 7 unwound from the roll body R1 of the holding shaft 21 is sequentially stretched to the roller 22 and the feeding roller 23. The feeding roller 23 is a driven roller which has a circumferential surface made of rubber, and is rotated by receiving a driving force from a motor which is not illustrated. Also, the feeding roller 23 has a function of feeding the medium 7 by being rotated in a state of winding the medium 7 which is drawn out from the holding shaft 21. In addition, in order for the feeding roller 23 to be capable of reliably feeding the medium 7, a pressing roller 24 which protrudes to the feeding roller 23 is provided in the feeding unit 2, and the pressing roller 24 presses the feeding roller 23 with the medium 7 pinching therebetween.

Meanwhile, the winding unit 5 is disposed on a lower side of the platen 30 in the X (+) direction (obliquely lower side of FIG. 1), and is provided with a winding shaft 19 which is rotatable. The winding shaft 19 supports the roll body R2 around which the medium 7 is wound.

The drying unit 4 is disposed directly under the platen 30 between the feeding unit 2 and the winding unit 5 in the X direction. Moreover, the drying unit 4 is disposed slightly upper than the feeding unit 2 and the winding unit 5. Also, the medium 7 being transported from the feeding unit 2 to the winding unit 5 is guided by a sheet transporting system which is constituted of ten rollers 70 to 79, and sequentially passes through the printing unit 3 and the drying unit 4.

In detail, the medium 7 which is fed by the feeding roller 23 of the feeding unit 2 is sequentially stretched to a driving roller 70 and the rollers 71 and 72. The driving roller 70 is rotatable and pivoted at one end of a rotation frame 701. That is, the driving roller 70 is rotatable based on a rotation shaft 702 which is integral with the rotation frame 701. Also, the driving roller 70 comes into contact with the medium 7, which is stretched between the feeding roller 23 and the roller 71, from the upper side due to its own weight, and applies tension to the medium 7.

Two rollers 73 and 74 are sequentially arranged in the printing unit 3, which is disposed on an upper side of the roller 72, in the X (+) direction. Regarding the rollers 73 and 74, the roller 73 is a driven roller which includes a plurality of minute metallic protrusions on a circumferential surface thereof and is rotated by receiving a driving force from a motor which is not illustrated.

Also, the transporting roller 73 transports the medium 7 onto the platen 30 by being rotated in a state of in which the medium 7, which is transported from the rollers 71 and 72, is wound. Moreover, in order for the transporting roller 73 to reliably perform transportation of the medium 7, the pressing roller 79 which is biased toward the transporting roller 73 is provided in the printing unit 3, and the pressing roller 79 presses the transporting roller 73 with the medium 7 being pinched therebetween.

Also, the transporting roller 73 and the roller 74 are disposed along the X direction so as to pinch the platen 30 therebetween, and positions of the rollers 73 and 74 are adjusted so that an apex of each roller is the same height as that of an upper surface of the platen 30 (a surface supporting the medium 7). The medium 7 wound around the transporting roller 73 slidably comes into contact with the upper surface of the platen 30 in a horizontal direction (X direction) until reaching the roller 74, and the medium 7 wound around the roller 74 is guided downward.

Two rollers 75 and 76 are sequentially disposed on a lower side of the roller 74 (a lower side than the base 6) along the X (−) direction. The medium 7 which is wound around the roller 75 and the roller 76 is guided in parallel (that is, horizontally) along the X direction between both the rollers 75 and 76. In addition, the drying unit 4 is disposed between the rollers 75 and 76. Therefore, a direction of the medium 7 wound around the roller 75 is varied to the X (−) direction, and the medium passes through the inside of the drying unit 4 until reaching the roller 76.

Two rollers 77 and 78 are disposed on a lower side of the roller 76 along the X (+) direction. Also, a direction of the medium 7 wound around the roller 77 is varied toward the X (+) direction, and the medium reaches the roller 78. In addition, the medium 7 which is wound around the roller 78 is wound around the winding unit 5 disposed in the X (+) direction of the roller 78.

As described above, the medium 7 fed from the feeding unit 2 passes through the printing unit 3 or the drying unit 4 and is wound around the winding unit 5. Also, the printing unit 3 performs a printing process on the medium 7 or the drying unit 4 performs a drying process on the medium 7.

The printing process of the printing unit 3 is performed by the recording unit 31 disposed on an upper side of the platen 30. The recording unit 31 includes a carriage 32, a flat shape supporting plate 33 attached to a lower surface of the carriage 32, and a plurality of recording heads 34 attached to a lower surface of the supporting plate 33. In the recording unit 31, the ink, which is supplied by an ink supplying mechanism from an ink cartridge CR disposed on the X (−) direction side of the printing unit 3, is ejected from nozzles 35 of the recording head 34, and thus an image is printed on the medium 7.

In detail, the recording head 34 includes a common liquid chamber (not illustrated), a pressure generating chamber (not illustrated), a piezoelectric element (not illustrated), the nozzles 35, and the like. A plurality of nozzles 35 are formed on a surface facing the platen 30 of the recording head 34. The piezoelectric element is a piezoelectric actuator of a bending vibration mode or a piezoelectric actuator of a longitudinal vibration mode. In a state in which the ink is supplied to the pressure generating chamber, the piezoelectric element vibrates a vibration plate constituting a part of the pressure generating chamber, and generates a pressure variation in the pressure generating chamber, such that the ink is ejected from the nozzles 35 to the medium 7 using the pressure variation.

In the recording head 34, the vibration plate constituting a part of the pressure generating chamber is in contact with the piezoelectric element, and is vibrated by driving (vibrating) the piezoelectric element, and if the piezoelectric element stops to be driven, the vibration plate stops to be vibrated. However, when the piezoelectric element stops to be driven, the vibration plate does not immediately stop to be vibrated and residual vibration occurs. Also, when a signal waveform is observed in accordance with the residual vibration being output from the piezoelectric, it is possible to specify a state of the ink inside the recording head 34 (whether or not the ink is in a normal state, whether or not abnormal occurs due to mixing of bubbles into a head, whether or not abnormal occurs due to viscosity of the ink, or whether or not abnormal occurs due to adhesion of foreign materials such as paper to the nozzle 35).

A determination unit 16 (refer to FIG. 3) to be described later evaluates whether or not the nozzle 35 of the recording head 34 is normal from the signal waveform in accordance with the residual vibration being output from the piezoelectric element.

In described hereinafter, an inspection for evaluating whether or not the nozzle 35 of the recording head 34 is normal is referred to as an AID inspection using the signal waveform in accordance with the residual vibration being output from the piezoelectric element.

The carriage 32 is movable integrally with the supporting plate 33 and the recording head 34. Specifically, a first guide rail 36 extending in the X direction is provided in the printing unit 3, and the carriage 32 moves in the X direction along the first guide rail 36 by receiving a driving force from a motor which is not illustrated. Further, a second guide rail (not illustrated) extending in the Y direction is provided in the printing unit 3, and the carriage 32 moves in the Y direction along the second guide rail by receiving a driving force from a motor which is not illustrated.

Also, the carriage 32 of the recording unit 31 is two-dimensionally moved in the XY plane with respect to the medium 7 which stops on the upper surface of the platen 30, and thus printing in which an image is printed on the medium 7 is performed.

Specifically, the recording unit 31 alternately repeats an operation (main scanning) in which the ink is ejected to the medium 7 from the nozzle 35 of the recording head 34 by moving the carriage 32 in the X direction (main scanning direction) and an operation (sub scanning) in which the carriage 32 is moved in the Y direction (sub scanning direction), and performs the main scanning M times in accordance with a printing resolution, such that one time printing (one frame) is performed.

A predetermined range over the almost entire region on the upper surface of the platen 30 is a printable region, and printing of one frame is performed on the printing region of the medium 7 in accordance with the printing data. When a distance (hereinafter, refer to as intermittent transporting distance) corresponding to a predetermined length of the X direction (transporting direction) is set as a unit, the medium 7 is transported in the X direction. In the printing apparatus 100 of the embodiment, an intermittent transportation in which transportation and stoppage of the medium 7 at the intermittent transporting distance in the transporting direction are repeated is performed, and thus the recording unit 31 performs printing on the medium 7 at the time of the stoppage of the medium 7 (at zero speed). The printing of one frame indicates printing on the medium 7 performed by the recording unit 31 at the time of the stoppage of the medium in the intermittent transportation.

That is, when the printing of one frame is performed on a printing surface of the medium 7 stopped on the upper surface of the platen 30, and printing of one frame on the printing surface of the medium 7 is finished, the transporting roller 73 is rotated so as to transport the medium 7 in the X direction by the intermittent transporting distance, and an unprinted surface of the medium 7 is disposed on the upper surface of the platen 30.

Subsequently, when printing of new one frame is performed on the unprinted surface of the medium 7, and the printing of one frame on the unprinted surface of the medium 7 is finished, the transporting roller 73 is rotated again so as to transport the medium 7 in the X direction by the intermittent transporting distance. Also, a series of these operations is repeatedly performed.

That is, the printing apparatus main body 120 repeats an operation in which the printing of one frame is performed on the medium 7 and an operation in which the medium 7 after finishing the printing of one frame is transported by the intermittent transporting distance, such that a desired image is formed on the medium 7. In the embodiment, in the medium 7, the image being formed by the printing of one frame is multiply disposed along an intermittent transporting direction of the medium 7.

Moreover, in order to flatly hold the medium 7 stopped on the upper surface of the platen 30, the platen 30 is provided with a mechanism for sucking the medium 7 stopped thereon. Specifically, a plurality of suction holes which is not illustrated is opened to the upper surface of the platen 30, and a sucking unit 37 is attached to a lower surface of the platen 30. Also, the sucking unit 37 is operated, a negative pressure is generated in the suction hole on the upper surface of the platen 30, and the medium 7 is sucked to the upper surface of the platen 30. Also, when the sucking unit 37 flatly holds the medium 7 by sucking the medium 7 during the stoppage the medium 7 on the platen 30 to be printed, and if the printing is finished, the sucking unit stops to suck the medium 7 so as to be capable of smoothly transporting the medium 7.

Further, a heater 38 is attached to the lower surface of the platen 30. The platen 30 is heated at substantially 35° C. to 45° C. by the heater 38. The printing process is performed on the medium 7 by the recording head 34, and at the same time, the medium is primarily dried due to heat of the platen 30. Because of the primary drying, the ink landed onto the medium 7 is primarily dried, and for example, a defect that the ink landed onto a target position (pixel) of the medium 7 spreads so as to interfere with ink landed onto a target position (adjacent pixel) of the medium 7 is suppressed.

In this manner, on the upper surface of the platen 30, the medium 7 in which the printing of one frame is performed and is primarily dried is moved by the intermittent transportation, and reaches the drying unit 4. That is, the medium 7 in which the printing of one frame is performed is brought in the drying unit 4 by the intermittent transportation. Also, in the printing unit 3, during performing printing of new one frame on the unprinted surface of the medium 7, the medium 7 in which the printing of one frame is performed remains in the drying unit 4. Air heated by a hot air blowing mechanism 50 (refer to FIG. 2) is supplied to the medium 7 which remains in the drying unit 4, and a drying process in which the ink landed onto the printing surface of the medium 7 is completely dried is performed.

In addition, it takes approximately six minutes when printing of new one frame is performed on the unprinted surface of the medium 7 in the printing unit 3. Therefore, the medium 7 is intermittently transported for an approximately six-minutes tact time, and a remaining time (drying time) of the medium 7 in the drying unit 4 is approximately six minutes. Accordingly, the drying process is performed on the medium 7 on which the printing of one frame is performed for approximately six minutes during the drying unit 4.

Also, the medium 7 on which the drying process is performed in the drying unit 4 is moved by the intermittent transportation, reaches the winding unit 5, and is wound around the winding unit 5 as the roll body R2.

The maintenance unit 9 is disposed on the X (−) direction side with respect to the platen 30. The maintenance unit 9 includes a cap 91, which is provided in an one-to-one corresponding relationship with respect to the recording head 34 of the recording unit 31, and an elevating unit 93 which elevates the cap 91. The maintenance unit 9 performs a maintenance work on the recording head 34 which is evacuated to a home position (directly positioned on maintenance unit) at the time of not printing.

The maintenance work is a work in which printing is temporarily stopped, transportation of the medium 7 is stopped, and the recording head 34 is recovered to a normal state. For example, in a case in which generation of defective nozzles in the nozzles 35 of the recording head 34 is recognized by the AID inspection, the printing is temporarily stopped, the transportation of the medium 7 is stopped, the predetermined maintenance work is performed, and the defective nozzles are recovered to the normal state. That is, in the printing apparatus main body 120, the maintenance work is performed in a state in which the printing on the medium 7 is temporarily stopped, and the printing on the medium 7 restarts when the maintenance work is finished.

The maintenance work is performed in a case in which a use of the recording head 34 reaches a predetermined condition, a case in which a defect is generated in an image printed on the medium 7, or the like, in addition to a case in which the generation of the defective nozzles in the nozzles 35 of the recording head 34 is recognized by the AID inspection. As an example of the case in which the use of the recording head 34 reaches a predetermined condition, there are a case in which a continuous driving time of the recording head 34 exceeds a predetermined time, a case in which a transporting distance of the medium 7 printed by the recording head 34 reaches a predetermined length, or the like.

The maintenance work includes a flushing process and a wiping process which is performed after the flushing process.

In the flushing process, the cap 91 is elevated by the elevating unit 93, a negative pressure is generated inside the cap 91 in a state in which a surface on which the nozzles 35 of the recording head 34 are formed is capped, and ink inside an ink flow passage of the recording head 34 is forcibly discharged from the nozzles 35. By the flushing process, degraded ink (ink with high viscosity, ink including foreign materials, ink including bubbles, and the like) is forcibly discharged from the inside of the ink flow passage of the recording head 34.

In the wiping process, the surface in which the nozzles 35 of the recording head 34 are formed is wiped with a wiper (not illustrated). By the wiping process, ink, dirt, foreign materials, and the like attached to the surface in which the nozzles 35 of the recording head 34 are formed is wiped off with the wiper.

In the embodiment, as the maintenance work, a basic process constituted of the flushing process and the wiping process is performed two times.

Next, a configuration of the drying unit 4 will be described.

As illustrated in FIG. 2, the drying unit 4 includes a case 44 in a box shape in which the inside is empty, supplies the heated air to the medium 7, heats the medium 7, and dries the printing surface of the medium 7.

The medium 7 is constituted of a printing member 7*a* on which printing is performed by ejecting ink in the printing unit 3, and a supporting member 7*b* which can be peeled off from the printing member 7*a*.

The printing member 7*a* is disposed on a side to which the ink is ejected from the nozzles 35 of the recording head 34, and constitutes the printing surface of the medium 7. The printing member 7*a* is made of, for example, a resin film such as a cellophane, oriented polypropylene, polyethylene terephthalate, oriented polystyrene, or polyvinyl chloride. That is, the printing member 7*a* is made of a material (resin) to which moisture in the air is hardly absorbed.

The supporting member 7*b* is disposed on a side of the rollers 22, 23, 71, 73, 74, 75, 76, 77, and 78 which are transports the medium 7, and supports the printing member 7*a*. The supporting member 7*b* is made of high-quality paper, craft paper, copy paper, glassine paper, parchment paper, rayon paper, coated paper, synthetic paper, or the like. That is, the supporting member 7*b* is a fiber aggregate and is made of a material (paper) to which moisture in the air is easily absorbed.

In addition, an adhesive (not illustrated) is disposed between the printing member 7*a* and the supporting member 7*b*, and the printing member 7*a* is attached to the supporting member 7*b* by the adhesive so as to be capable of being peeled off from the supporting member.

An air supplying port 45 is formed to be opened on a lower portion of a side wall portion on the X (+) direction side of the case 44. The hot air blowing mechanism 50 is connected to the air supplying port 45 through an air supplying duct 46.

The hot air blowing mechanism 50 is provided with an axial fan 51 and a heater 52. In the hot air blowing mechanism 50, the air heated by the heater 52 is supplied to the inside of the case 44 by the axial fan 51 through the air supplying port 45 and an air supplying duct 46, and an inner space 43 of the case 44 is heated.

Therefore, a temperature of the drying unit 4 (temperature of inner space 43) is controlled depending on a temperature of hot air which is supplied from the hot air blowing mechanism 50 to the inner space 43. In other words, a control of electric connection to the heater 52 or a temperature control of the heater 52 is performed, and the temperature of the drying unit 4 (temperature of inner space 43) is controlled. That is, in the embodiment, the control of electric connection to the heater 52 or the temperature control of the heater 52 is performed, and the temperature of the drying unit 4 is elevated, or the temperature of the drying unit 4 is decreased.

Also, the heater 52 is an example of a "heater of the drying unit".

In addition, an air exhausting port 47 is formed to be opened in the substantially center of an upper wall portion of the case 44, and an air exhausting fan 49 is connected to the air exhausting port 47 through the air exhausting duct 48. Also, the heated air inside the inner space 43 is exhausted to the outside of the case 44 through the air exhausting duct 48 according to driving of the air exhausting fan 49. As a result, a flowage of the heated air is generated in the inner space 43 of the case 44.

Further, in the side wall portion of the case 44, a pair of right and left passing ports 27 and 28 are formed on the X (+) direction side and the X (−) direction side with respect to the air exhausting port 47. Regarding the passing ports 27 and 28, a dimension of each of them in the Y direction is greater than a dimension of the medium 7 in the Y direction (dimension in a with direction), such that the medium 7 can pass through these ports.

Inside the case 44, a guide member 26 is disposed between the passing port 27 and the passing port 28. The guide member 26 supports the supporting member 7*b* of the medium 7, and guides the medium 7 which is brought from the passing port 27 to the passing port 28.

Further, inside the case 44, a plurality of the axial fans 42 is disposed along the transporting direction of the medium 7 so as to face the guide member 26. The axial fan 42 is disposed so that an air blowing direction thereof is substantially perpendicular to the printing surface of the medium 7 (printing member 7*a*). Also, the air heated by the hot air blowing mechanism 50 is blown as hot air toward the printing surface (printing member 7*a*) of the medium 7 by the axial fan 42, and thus the medium 7 is heated and the printing surface of the medium 7 is dried.

That is, in the drying unit 4, the air which is heated by the heater 52 of the hot air blowing mechanism 50 is supplied to the medium 7, and the ink landed to the printing member 7*a* of the medium 7 is completely dried and fixed to the printing member 7*a* of the medium 7.

As described above, in the printing apparatus main body 120, the printing unit 3 repeats the operation in which the printing of one frame is performed on the medium 7 and the operation in which the medium 7 is transported at the intermittent transporting distance L after the printing of one frame, and the images of the one frame are repeatedly formed on the medium 7. Further, in the drying unit 4, the drying process is performed on the medium 7, and the ink landed on the medium 7 is dried and fixed to the medium 7.

The temperature (a predetermined temperature) of the drying unit 4 which performs the heating process on the medium 7 is set to a temperature (75° C.) at which a thermal damage is not easily generated in the medium 7, even when the drying unit 4 performs the heating process at a tack time (six minutes) of the printing apparatus main body 120. Further, in a case in which the heating process temperature of the drying unit 4 is 75° C., when the drying unit 4 performs the heating process for six minutes, the ink landed on the medium 7 can be dried and fixed thereto.

Moreover, details will be described later, but in a case in which the heating process is performed for a long time over six minutes by the drying unit 4, there is a concern that a thermal damage such as wrinkles may be generated in the medium 7. Further, even in a case in which the heating process is performed for a long time over six minutes by the drying unit 4, a thermal damage is not easily generated in the medium 7 in the drying unit 4, and thus it is preferable that the temperature of the drying unit 4 is set to be equal to or less than approximately 50° C.

As illustrated in FIG. 3, the host device 110 includes a display unit 111 and a hard disk 112. The display unit 111 is configured with, for example, a liquid crystal display device including a touch panel, and displays various information items required for a printing control. Further, a worker can register various settings through the touch panel of the display unit 111. The various information items required for the printing control are stored in the hard disk 112.

The printing apparatus main body 120 includes the controller 10 and a buffer memory 11. Printing data written by the host device 110 is supplied to the printing apparatus main body 120 through a system bus, and stored in the buffer memory 11.

The controller 10 is provided with a memory 12, the CPU 13, a counter 17, a control circuit 15, and the like. The memory 12, the CPU 13, the counter 17, and the control circuit 15 are connected to each other by the system bus.

The CPU 13 is a processing device for controlling the entire printing apparatus main body 120, reads required information in printing data from the buffer memory 11, transmits a control signal to the control circuit 15 based on the read information. The control circuit 15 controls each of the feeding unit 2, the printing unit 3, the drying unit 4, the winding unit 5, the maintenance unit 9, and the like. In the memory 12, information relating to programs for operating the CPU 13, calculation results of the CPU 13, and the like are stored. The counter 17 acquires the number of the maintenance works (count value n) being performed.

Further, the CPU 13 includes a receiving unit 14 and the determination unit 16. An outline (function) of the receiving unit 14 and the determination unit 16 will be described later.

Problems of Printing Apparatus

Next, problems of the printing apparatus 100 according to the embodiment will be described.

As described above, the medium 7 is constituted of a printing member 7*a* made of a material (resin) to which moisture is hardly absorbed and the supporting member 7*b* made of a material (paper) to which moisture is easily absorbed.

If the heating process is performed for a long time by the drying unit 4, the printing member 7*a* thermally expands, and the dimension of the printing member 7*a* is elongated. Meanwhile, if the heating process is performed for a long time by the drying unit 4, since moisture included in the supporting member 7*b* is evaporated, and intervals between fibers constituting the supporting member 7*b* are shortened, the printing member 7*b* thermally shrinks, and the dimension of the printing member 7*b* is shortened.

Therefore, if the heating process is performed for a long time by the drying unit 4, since the printing member 7*a* thermally expands, and the supporting member 7*b* thermally shrinks, the printing member 7*a* is peeled off from the supporting member 7*b*, the printing member 7*a* floats from the supporting member 7*b*, and the thermal damage such as wrinkles is generated in the medium 7.

In the printing apparatus 100, for example, in a case in which generation of defective nozzles in the nozzles 35 of the recording head 34 is recognized by the AID inspection, the printing is temporarily stopped, and thus the maintenance work is performed. For example, during the maintenance work, the medium 7 is stopped to be transported, and the medium 7 remains in the drying unit 4, the drying unit 4 performs the heating process for a long time over approximately six minutes (excessive heating process), and thus the thermal damage such as wrinkles is generated in the medium 7, and there is a concern that the medium 7 may become defective. That is, in a case in which printing is temporarily stopped and the maintenance work is performed, the excessive heating process is performed on the medium 7 which remains in the drying unit 4, the thermal damage such as wrinkles is generated in the medium 7, and thus there is a concern that the medium 7 may become defective and need to be discarded.

Further, if a new medium 7 is wound around the medium 7 in which the thermal damage such as wrinkles is generated, the thermal damage also badly influences on the new medium 7, and there is a concern that the new medium 7 may also become defective. Further, if the thermal damage such as wrinkles becomes remarkable, there is a concern that a winding shape of the roll body R2 of the medium 7 which is wound by the winding unit 5 may be disordered.

The printing apparatus 100 according to the embodiment includes a configuration in which the thermal damage such as wrinkles is hardly generated in the medium 7 which remains in the drying unit 4 even in a case in which the printing is temporarily stopped by the maintenance work. That is, the embodiment includes an excellent configuration in which, in the printing apparatus 100 which is provided with the drying unit 4 drying the ink applied onto the medium 7, the thermal damage such as wrinkles is not easily generated in the medium 7, in a case in which the printing is temporarily stopped and the predetermined maintenance work is performed, even in a case in which the drying unit 4 performs the heating process for a long time over approximately six minutes.

Hereinafter, details thereof will be described.

Control Method of Printing Apparatus

Figure 4:
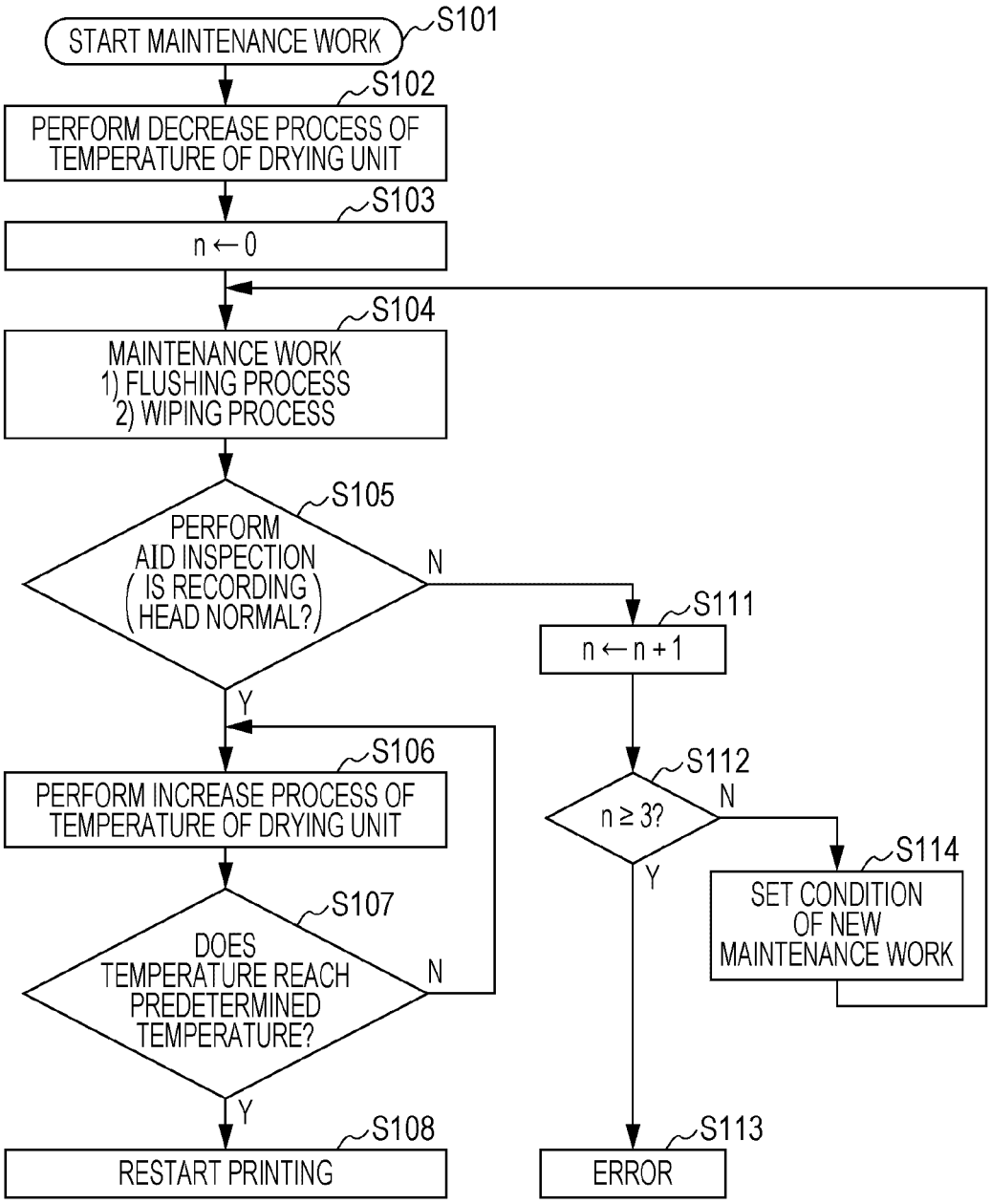
FIG. 4 is a flow chart illustrating a first control method of the printing apparatus according to the embodiment.
Figure 5:
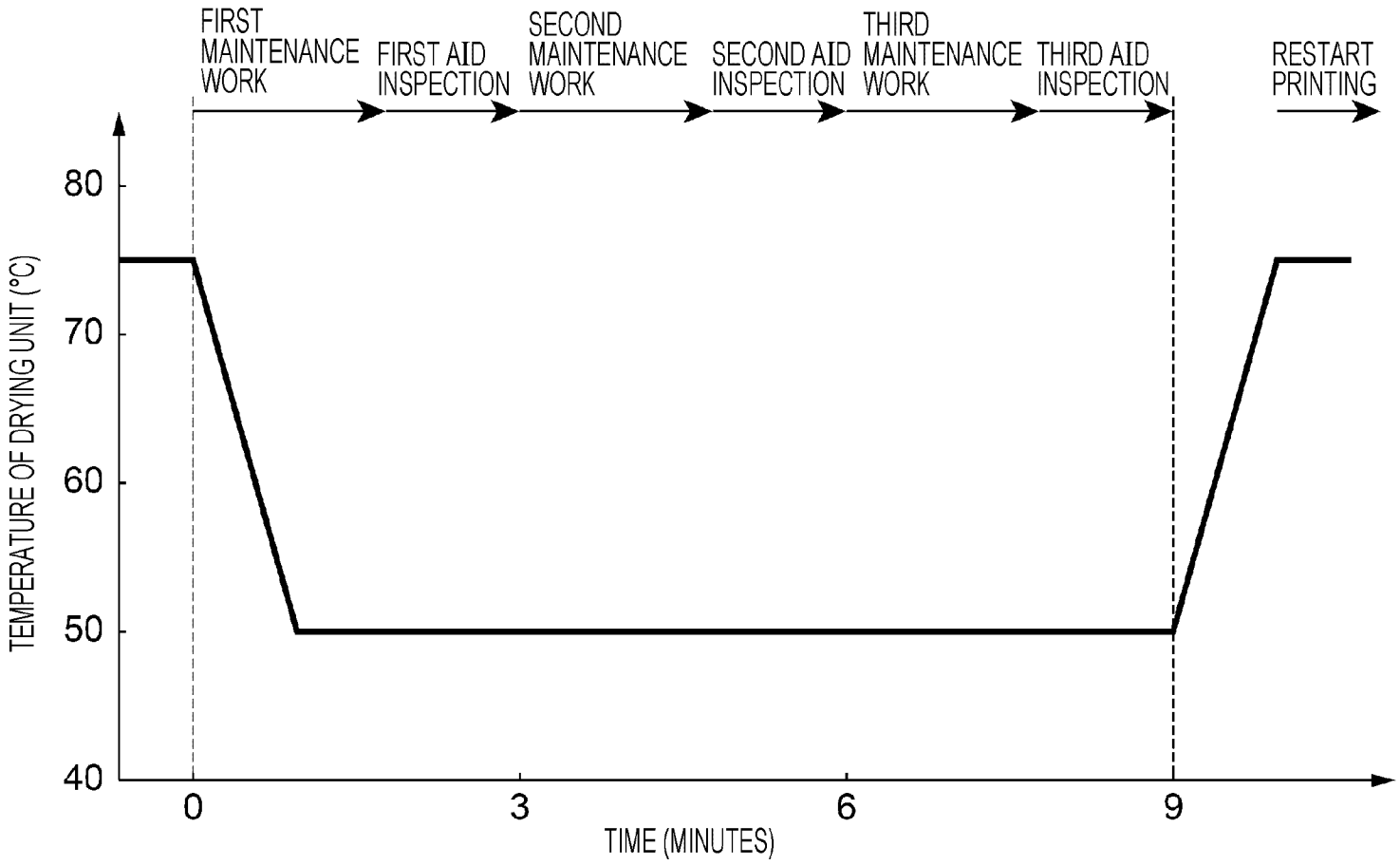
FIG. 5 is a view illustrating a state of a temperature of the drying unit in a case in which the first control method is performed.
Figure 6:
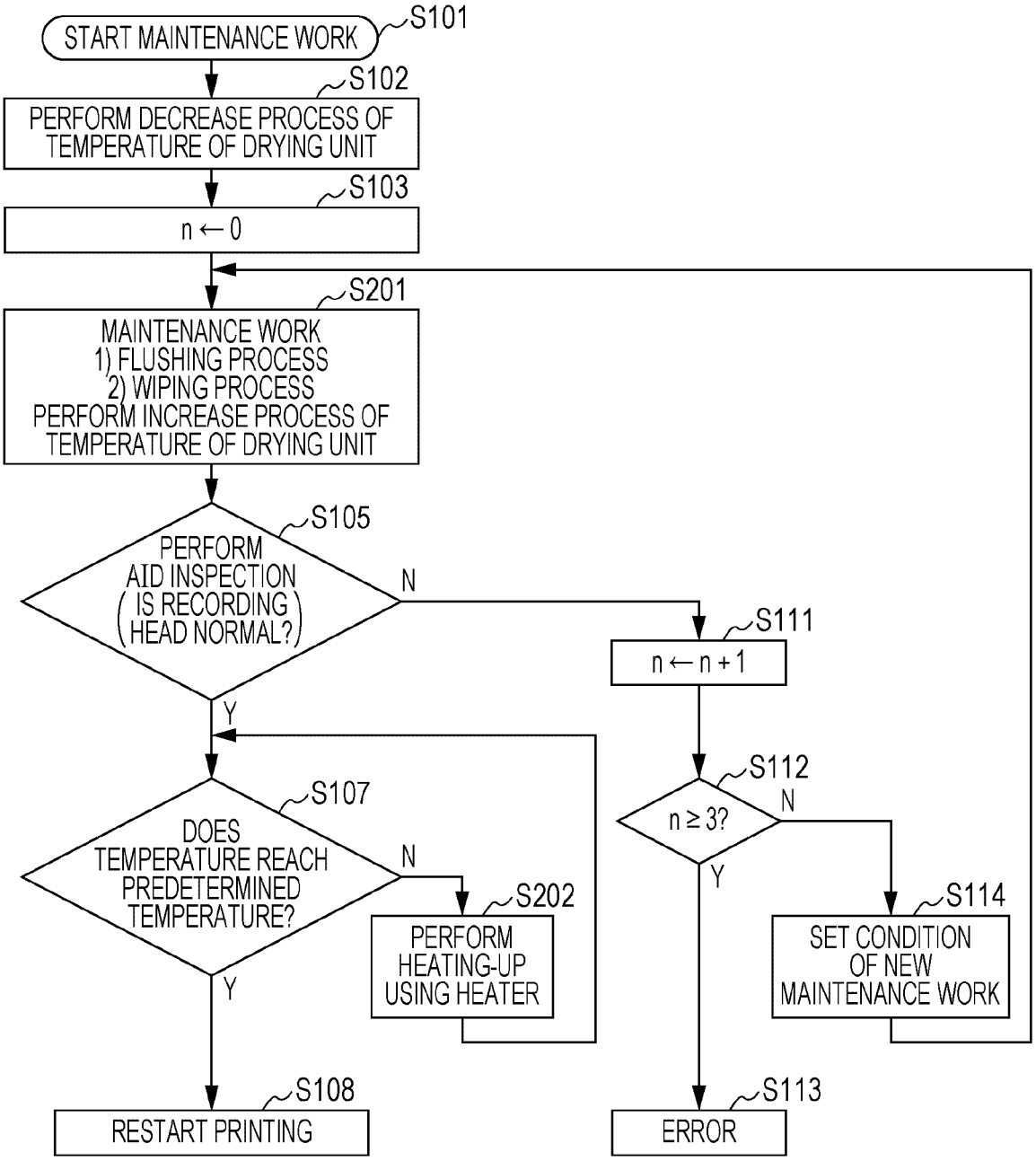
FIG. 6 is a flow chat illustrating a second control method of the printing apparatus according to the embodiment.
Figure 7:
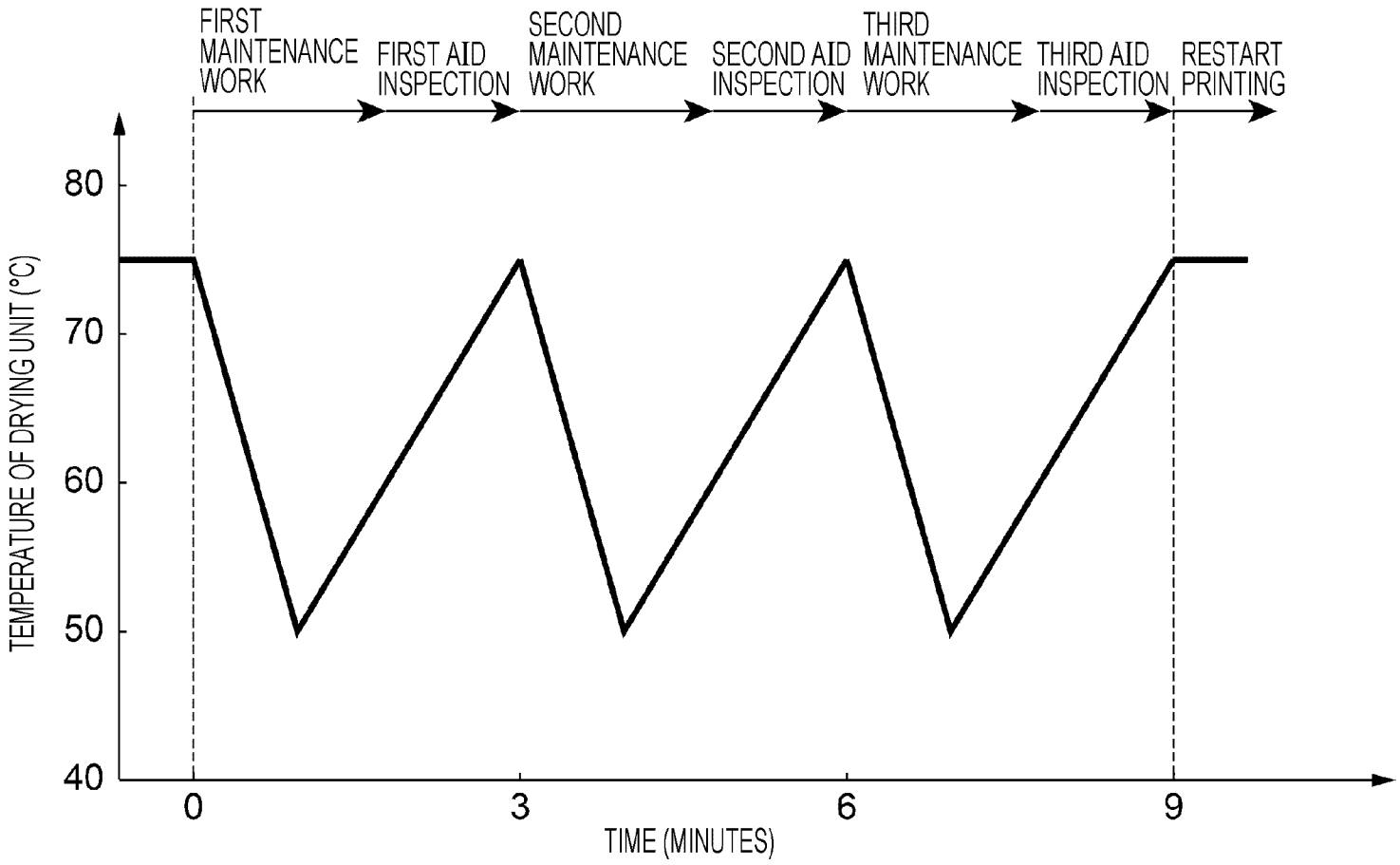
FIG. 7 is a view illustrating a state of the temperature of the drying unit in a case in which the second control method is performed.

FIG. 4 is a flow chart illustrating a first control method of the printing apparatus according to the embodiment. FIG. 5 is a view illustrating a state of the temperature of the drying unit in a case in which the first control method is performed. FIG. 6 is a flow chart illustrating a second control method of the printing apparatus according to the embodiment. FIG. 7 is a view illustrating a state of the temperature of the drying unit in a case in which the second control method is performed.

In addition, FIGS. 5 and 7 are views corresponding to a case in which the maintenance work causing the recording head 34 to be recovered to the normal state is performed three times, and the recording head 34 is recovered to the normal state by a third maintenance work, the temperature of the drying unit 4 is illustrated on a vertical axis, and the time is illustrated on a horizontal axis. Further, FIGS. 5 and 7 schematically illustrate a state (maintenance work, AID inspection, and restarting of printing) of the printing apparatus 100 corresponding to an elapsed time of the horizontal axis. Moreover, regarding the state (maintenance work, AID inspection, and restarting of printing) of the printing apparatus 100 corresponding to the elapsed time of the horizontal axis of FIGS. 5 and 7, a length of a horizontal axis direction does not correspond to a required time taken for an actual maintenance work or a required time taken for an actual AID inspection. That is, FIGS. 5 and 7 schematically illustrate the state of the printing apparatus 100 which corresponds to the temperature of the drying unit 4.

Moreover, the first control method in the printing apparatus 100 is an example of the "first mode", and hereinafter, is simply referred to as the first mode. The second control method in the printing apparatus 100 is an example of the "second mode", and hereinafter, is simply referred to as the second mode. The printing apparatus 100 according to the embodiment includes a configuration in which the first mode (first control method) or the second mode (second control method) can be selected.

First, with reference to FIGS. 4 and 5, an outline of the first mode will be described. In the embodiment, in a case in which a defect is generated in the recording head 34, the maintenance work in which the recording head 34 is recovered to the normal state is performed three times, and the recording head 34 is recovered to the normal state by the third maintenance work.

In addition, in the embodiment, an icon for selecting the first mode and an icon for selecting the second mode are provide in the display unit 111. When a worker touches the icon of the display unit 111, the receiving unit 14 receives performing of the first mode or the second mode. That is, the printing apparatus 100 includes the receiving unit 14 which receives selecting of the first mode or the second mode. Also, in description hereinafter, in the printing apparatus 100, the receiving unit 14 receives the performing of the first mode.

As illustrated in FIG. 4, in a case in which generation of defective nozzles in the nozzles 35 of the recording head 34 is recognized by the AID inspection, the case in which the use of the recording head 34 reaches a predetermined condition, a case a defect is generated in an image printed in the medium 7, or the like, the printing on the medium 7 is temporarily stopped, and the maintenance work starts (S101).

In addition, there is a case in which the maintenance work automatically starts, or a case in which the maintenance work is manually started by being selected from a worker. For example, the CPU 13 determines that the recording head 34 needs to be maintained in the case in which the use of the recording head 34 reaches a predetermined condition, causes the printing to be automatically stopped, and causes the maintenance work to automatically start. For example, in a case in which the defect is generated in the image, the worker starts the maintenance work manually.

Moreover, regarding a timing when the printing on the medium 7 is temporarily stopped, printing on the medium is temporarily stopped at a timing after finishing the printing of one frame, in other words, at a timing when the printing by the recording unit 31 is not performed and the medium 7 is stopped.

In a case in which the maintenance work starts, the CPU 13 performs the control of the electric connection to the heater 52 or the temperature control of the heater 52 so that the temperature of the drying unit 4 is decreased (S102). That is, after S101 (maintenance work starts) is performed, the temperature of the drying unit 4 is decreased. Then, the temperature of the drying unit 4 is decreased to 50° C. (standby temperature) from 75° C. (predetermined temperature), and when the temperature of the drying unit 4 reaches 50° C., the temperature of the drying unit 4 is maintained at 50° C. (standby temperature) (refer to FIG. 5). In other words, in S102, the temperature of the drying unit 4 is decreased to a temperature (50° C.) at which a thermal damage such as wrinkles is not easily generated in the medium 7.

Moreover, "after the interruption work starts" in this disclosure corresponds to after S101 (maintenance work starts) is performed. Therefore, in the embodiment, after S101 is performed (after the interruption work starts), S102 (a decreasing process of the temperature of the drying unit 4) is performed. That is, after S101 is performed (after the interruption work starts), the CPU 13 performs the control of the electric connection to the heater 52 or the temperature control of the heater 52 of the drying unit 4 so that the temperature of the drying unit 4 is decreased.

Subsequently, in S103, the CPU 13 sets the count value n in the counter 17 as zero (initial value). Moreover, S102 and S103 may be simultaneously performed, or S103 may be performed before S102.

Subsequently, in S104, the CPU 13 controls the maintenance unit 9, and performs the first maintenance work. Moreover, the first maintenance work is a maintenance work which is performed in S104 in a case in which the count value n is set as zero (initial value). Regarding the maintenance work in S104, the basic process constituted of the flushing process and the wiping process is performed two times.

Moreover, the first maintenance work which is performed in a case in which the count value n is set as zero 0 (initial value) is an example of the "interruption work".

In the embodiment, S102 (the decreasing process of the temperature of the drying unit 4) is performed prior to S104 (maintenance work), but it is not limited thereto. S102 (the decreasing process of the temperature of the drying unit 4) may be simultaneously performed with S104 (maintenance work), or may be performed in the middle of S104 (maintenance work).

Subsequently, in S105, the CPU 13 performs a first AID inspection, and determines whether or not the recording head 34 is recovered to the normal state by the first maintenance work in S104. In addition, a predetermined time taken from the maintenance work of S104 to the AID inspection of S105 is approximately three minutes.

In a case in which the recording head 34 in S105 is determined to be recovered to the normal state (in a case in which determination is Y in S105), S106 (an increasing process of the temperature of the drying unit 4) is performed.

In a case in which the recording head 34 is determined to be not recovered to the normal state in S105 (in a case in which determination is N in S105), through S111, S112, and S114, a new maintenance work (second maintenance work) in S104 is performed.

As described above, S105 (AID inspection) is an example of a "determination work" for determining whether or not a new maintenance work is performed, and in a case in which determination is N in S105, through S111, S112, and S114, the new maintenance work (second maintenance work) in S104 is performed. In other words, in S105 (AID inspection), after the first maintenance work (S104), a determination work for performing whether or not a new maintenance work which is the same as the first maintenance work, or a new maintenance work which is different from the first maintenance work is performed.

In a case in which determination is Y in S105, and S106 (an increasing process of the temperature of the drying unit 4) is performed, the CPU 13 performs the control of the electric connection to the heater 52 or the temperature control of the heater 52 so that the temperature of the drying unit 4 is increased. Then, the temperature of the drying unit 4 is increased to 75° C. (predetermined temperature) from 50° C. (standby temperature) (refer to FIG. 5).

Subsequently, in S107, the CPU 13 evaluates whether or not the temperature of the drying unit reaches a predetermined temperature (75° C.)

In a case in which the temperature of the drying unit 4 is evaluated to reach a predetermined temperature in S107 (in a case in which determination is Y in S107), the CPU 13 performs the control of the electric connection to the heater 52 or the temperature control of the heater 52 so that the temperature of the drying unit 4 is maintained at a predetermined temperature (75° C.), and in S108, the CPU 13 controls the feeding unit 2, the printing unit 3, the drying unit 4, and the winding unit 5, and restarts the printing on the medium 7.

In a case in which the temperature of the drying unit 4 is evaluated not to reach the predetermined temperature in S107 (in a case in which determination is N in S107), the CPU 13 continuously performs S106 (the increasing process of the temperature of the drying unit 4) until the temperature of the drying unit 4 reaches the predetermined temperature (75° C.). Also, when the temperature of the drying unit 4 reaches the predetermined temperature, the CPU 13 performs the control of the electric connection to the heater 52 or the temperature control of the heater 52 so that the temperature of the drying unit 4 is maintained at a predetermined temperature (75° C.), and S108 (restarting of printing) is performed.

In the embodiment, since the recording head 34 is recovered to the normal state in the third maintenance work (S104), determination is N in S105 (first AID inspection), and S111 is performed. In S111, the CPU 13 causes the counter 17 to count up the count value n. In detail, since the count value n is set to zero (initial value) in S103, the count value n is counted up from zero to one in S111.

Subsequently, in S112, the CPU 13 determines whether or not the count value n is three or more (determination is Y or not), and whether or not the count value n is smaller than three (determination is N or not). Since the count value n which is counted up in S111 is one, the count value n is determined to be smaller than three in S112 (determination is N), and S114 is performed.

In S114, the determination unit 16 sets a condition of a new maintenance work (second maintenance work). That is, the determination unit 16 sets conditions of the flushing process and the wiping process in the new maintenance work (second maintenance work).

The condition of the flushing process is a pressure (degree of negative pressure) in the inside of the cap 91 in which the recording head 34 is capped, or a time (suction time when the negative pressure acts) when the ink is forcibly discharged from the nozzle 35 by the negative pressure. For example, when the negative pressure is lowered and the suction time is longer, the deteriorated ink is likely to be discharged from the recording head 34.

The condition of the wiping process is a pressing force of a wiper with respect to the recording head 34 or a moving speed of the wiper. For example, when the pressing force of the wiper becomes strong and the moving speed of the wiper becomes slow, dirt or foreign materials are likely to be removed from the recording head 34.

In a case in which the ink flow passage of the recording head 34 is blocked due to the deteriorated ink, a case in which the nozzle 35 is blocked due to dirt or foreign materials, or the like, since the recording head 34 is determined to be not recovered to the normal state, when the condition such as the negative pressure or the suction time in the flushing process, or the pressing force or the moving speed in the wiping process is changed, the recording head 34 is likely to be recovered to the normal state.

However, when the condition of the flushing process is changed in a direction where the recording head 34 is easily recovered to the normal state, there is a concern that an adverse influence of which the ink is easily wasted occurs. When the condition of the wiping process is changed in the direction where the recording head 34 is easily recovered to the normal state, there is a concern that an adverse influence of which the recording head 34 is easily damaged occurs.

In consideration of such adverse influences, a worker registers (stores) the conditions of the flushing process and the wiping process in a new maintenance work to the memory 12 through the display unit 111. The determination unit 16 sets a condition of the new maintenance work with reference to the conditions stored in the memory 12. That is, the determination unit 16 determines whether or not the maintenance work which is the same as the first maintenance work, or the maintenance work which is different from the first maintenance work is performed with reference to the registered conditions.

Moreover, the maintenance work which is the same as the first maintenance work is an example of a "first interruption work", and hereinafter, is simply referred to as the first maintenance work. The maintenance work which is different from the first maintenance work is an example of a "second interruption work", and hereinafter, is simply referred to as a second maintenance work.

Subsequently, in S104, the CPU 13 controls the maintenance unit 9, and performs the second maintenance work under the conditions of the new maintenance work set in S114.

Subsequently, in S105, the CPU 13 performs a second AID inspection, and determines whether or not the recording head 34 is recovered to the normal state by the second maintenance work of S104. Also, in a case in which the recording head 34 is determined to be recovered to the normal state in S105 (in a case in which determination is Y in S105), S106 is performed.

In a case in which the recording head 34 is determined to be not recovered to the normal state in S105 (in a case in which determination is N in S105), S111 is performed.

In the embodiment, since the recording head 34 is recovered to the normal state by the third maintenance work (S104), determination is N in S105 (second AID inspection), and S111 is performed. In S111, the CPU 13 causes the counter 17 to count up the count value n from one to two.

Since the count value n counted up in S111 is two, the count value n is determined to be smaller than three in S112 (N), and the condition of the new maintenance work is set in S114. Also, in S104, the CPU 13 controls the maintenance unit 9, and performs the third maintenance work under a condition of the new maintenance work set in S114.

Subsequently, in S105, the CPU 13 performs a third AID inspection, and determines whether or not the recording head 34 is recovered to the normal state by the third maintenance work. In the embodiment, since the recording head 34 is recovered to the normal state by the third maintenance work (S104), the recording head 34 is determined to be recovered to the normal state in the third AID inspection (S105) (determination is Y in S105), and through S106 and S107, the printing on the medium 7 restarts in S108.

Moreover, the third maintenance work is an example of the last "first interruption work" or the "last second interruption work".

In S105, presumably, in a case in which the recording head 34 is determined to be not recovered to the normal state (in a case in which determination is N), S111 is performed. In S111, the CPU 13 causes the counter 17 to count up the count value n in from two to three.

Since the count value n in S111 is counted up to three, the count value n in S112 is determined to be equal to or more than three (Y), and S113 is performed.

In S113, the CPU 13 determines that the recording head 34 is not easily recovered to the normal state by the maintenance work of S104, and causes the display unit 111 to display an error (failure) message. Also, when the error message is displayed on the display unit 111, a worker performs a work for solving the error (for example, exchanging recording head 34).

In the embodiment, a case in which an upper limit value of the number of the maintenance works being performed in S104 is three is exemplified, but the upper limit value of the number of the maintenance works being performed in S104 can be changed. That is, the upper limit value of the number of the maintenance works being performed in S104 is not limited to three, and may be greater than three, or may be smaller than three.

As illustrated in FIG. 5, after S101 is performed (after starting the interruption work), the temperature of the drying unit 4 is decreased, and the temperature of the drying unit 4 reaches 50° C. (standby temperature) during the first maintenance work. When the temperature of the drying unit 4 reaches 50° C. (standby temperature), the temperature of the drying unit 4 is maintained at 50° C. (standby temperature) until the third AID inspection (S105) in which the recording head 34 is determined to be recovered to the normal state is finished.

Also, after the recording head 34 is determined to be recovered to the normal state in S105, the temperature of the drying unit 4 is continuously increased until the temperature of the drying unit 4 is increased and the temperature of the drying unit 4 reaches 75° C. (predetermined temperature). That is, after S101 is performed (after the starting of the interruption work), the temperature of the drying unit 4 is decreased by performing the control of electric connection to the heater 52 or the temperature control of the heater 52, and after the third maintenance work is finished and the third AID inspection (S105) is finished, the temperature of the drying unit 4 is increased by performing the control of electric connection to the heater 52 or the temperature control of the heater 52. Also, when the temperature of the drying unit 4 reaches 75° C. (predetermined temperature) and is maintained at 75° C. (predetermined temperature), the printing on the medium 7 restarts.

Moreover, "after the interruption work" in this disclosure corresponds to after determination is N in S105 (AID inspection)". Further, "at the time of finishing the determination work" in this disclosure corresponds to when determination is Y in S105 (AID inspection). That is, in the first mode, after determination is Y in the AID inspection (S105) (after the interruption work), the temperature of the drying unit 4 is increased by performing the control of electric connection to the heater 52 or the temperature control of the heater 52. In other words, in the first mode, when determination is Y in the AID inspection (S105) (when the determination work is finished), the temperature of the drying unit 4 is increased by performing the control of electric connection to the heater 52 or the temperature control of the heater 52.

For example, in a case in which the recording head 34 is recovered to the normal state by only the first maintenance work, in the first mode, after S101 is performed (after the starting of the interruption work), the temperature of the drying unit 4 is decreased by performing the control of electric connection to the heater 52 or the temperature control of the heater 52 of the drying unit 4, the temperature of the drying unit 4 is maintained at 50° C. (standby temperature) after the temperature of the drying unit 4 reaches 50° C. (standby temperature), and the temperature of the drying unit 4 is increased by performing the control of electric connection to the heater 52 or the temperature control of the heater 52 of the drying unit 4 after the first maintenance work.

That is, in the first mode, in a case in which the printing is temporarily stopped, and the first maintenance work set in advance is performed, after S101 is performed (after the starting of the interruption work), the temperature of the drying unit 4 is decreased by performing the control of electric connection to the heater 52 or the temperature control of the heater 52 of the drying unit 4 is performed, and the temperature of the drying unit 4 is increased by performing the control of electric connection to the heater 52 or the temperature control of the heater 52 of the drying unit 4 after determination is Y by the first AID inspection (S105) (after the interruption work).

Further, in the first mode, after S101 is performed (after the interruption work starts), the control of electric connection to the heater 52 or the temperature control of the heater 52 is performed so that the temperature of the drying unit 4 becomes the standby temperature (50° C.) which is lower than a temperature (predetermined temperature (75° C.)) at the time of starting the first maintenance work.

For example, in a case in which the recording head 34 is less likely to be recovered to the normal state by only the first maintenance work, and a new maintenance work (first maintenance work or second maintenance work) is further performed continuing the first maintenance work, in the first mode, the control of the electric connection to the heater 52 or the temperature control of the heater 52 is performed so that the temperature is maintained at 50° C. (standby temperature) during the new maintenance work, and the temperature of the drying unit 4 is increased by performing the control of the electric connection to the heater 52 or the temperature control of the heater 52 of the drying unit 4 after the new maintenance work is finished.

Further, in a case in which the new maintenance work (first maintenance work or second maintenance work) are repeatedly performed a plurality of times, in the first mode, the temperature of the drying unit 4 is increased by performing the control of the electric connection to the heater 52 or the temperature control of the heater 52 of the drying unit 4 after the last new maintenance work (first maintenance work or second maintenance work) is finished. That is, in a case in which the new maintenance work is repeatedly performed, the temperature of the drying unit 4 is increased by performing the control of the electric connection to the heater 52 or the temperature control of the heater 52 of the drying unit 4 after the last new maintenance work is finished.

Also, in the first mode, it is possible to exhibit following effects.

1) In a case in which the maintenance work is performed, since the temperature of the drying unit 4 is lower than 75° C. (predetermined temperature), compared to a case in which the temperature of the drying unit 4 is 75° C. (predetermined temperature), the thermal damage such as wrinkles is not easily generated in the medium 7 remaining in the drying unit 4.

2) In the first mode, during the middle of the first maintenance work to the third AID inspection (last AID inspection), the temperature of the drying unit 4 is maintained at a temperature (50° C.) at which the thermal damage such as wrinkles is not easily generated in the medium 7. That is, since the temperature of the drying unit 4 is maintained at temperature (50° C.) at which the thermal damage such as wrinkles is not easily generated in the medium 7 for a long time, the thermal damage such as wrinkles is not easily generated in the medium 7 remaining in the drying unit 4 further than a case in which the temperature of the drying unit is maintained at temperature (50° C.) at which the thermal damage such as wrinkles is not easily generated in the medium for a short time (second mode to be described later).

Moreover, during the first maintenance work to the third AID inspection, the temperature of the drying unit 4 is maintained at a temperature lower than 50° C., and thus it is possible that the thermal damage such as wrinkles is not easily generated in the medium 7 remaining in the drying unit 4 further than a case in which the temperature of the drying unit 4 is maintained at 50° C.

However, when the temperature of the drying unit 4 is maintained at a temperature lower than 50° C., compared to a case in which the temperature of the drying unit 4 is maintained at 50° C., the temperature of the drying unit 4 is necessary to be increased from the low temperature, and thus a time taken for performing a process of increasing the temperature of the drying unit 4 is increased in S106, and a standby time (loss time) taken until the printing on the medium 7 restarts is increased.

Therefore, when the temperature of the drying unit 4 is maintained at 50° C., compared to a case in which the temperature of the drying unit 4 is maintained at the temperature lower than 50° C., a standby time (loss time) taken until the printing on the medium 7 restarts can be reduced. That is, the "standby temperature" in this disclosure is preferably a temperature as high as possible within a range in which the thermal damage is not generated in the medium 7.

Next, with reference to FIGS. 6 and 7, an outline of the second mode will be mainly described based on differences from the first mode. In the second mode, in the same manner as the first mode, the maintenance work in which the recording head 34 is recovered to the normal state is performed three times, and the recording head 34 is recovered to the normal state by the third maintenance work.

Further, the printing apparatus 100 receives performing of the second mode using the receiving unit 14. In addition, in the second mode illustrated in FIG. 6, the same reference numeral is given to the same step as that of the first mode, overlapping described thereof will be omitted.

As illustrated in FIG. 6, in the second mode, the printing on the medium 7 is temporarily stopped, through S101 (maintenance work starts), S102 (the decreasing process of the temperature of the drying unit 4), and S103 (initial setting of the count value n), S201 is performed.

In S201, the CPU 13 controls the maintenance unit 9, and performs the first maintenance work. Moreover, the first maintenance work is performed in a case in which the count value n is set as zero (initial value), and the basic process constituted of the flushing process and the wiping process is performed two times.

Further, in S201, the CPU 13 performs the control of the electric connection to the heater 52 or the temperature control of the heater 52 of the drying unit 4 so that the temperature of the drying unit 4 is increased during the first maintenance work.

That is, in the second mode, even in a case in which it is not confirmed that the recording head 34 is recovered to the normal state by the maintenance work, the temperature of the drying unit 4 is increased during the maintenance work. Meanwhile, in the first mode, after it is confirmed that the recording head 34 is recovered to the normal state by the maintenance work, the temperature of the drying unit 4 is increased. This point is a difference between the second mode and the first mode.

In other words, in the second mode, it is expected that the recording head 34 is recovered to the normal state by the maintenance work, the temperature of the drying unit 4 is increased faster than that of the first mode, and the temperature of the drying unit 4 reaches 75° C. (predetermined temperature) faster than that of the first mode.

In a case in which the recording head 34 is determined to be recovered to the normal state in S105 (in a case in which determination is Y in S105), the temperature of the drying unit 4 is evaluated to reach or not a predetermined temperature in S107. Also, in a case in which the temperature of the drying unit 4 is evaluated to reach the predetermined temperature in S107 (in a case in which determination is Y in S107), the CPU 13 performs the control of the electric connection to the heater 52 or the control of the temperature of the heater 52 so that the temperature of the drying unit 4 is maintained at a predetermined temperature (75° C.), and S108 (restarting of printing) is performed.

In a case in which the temperature of the drying unit 4 is evaluated not to reach the predetermined temperature in S107 (in a case in which determination is N in S107), the heater 52 heats up in S202 (the increasing process of the temperature of the drying unit 4). Also, when the temperature of the drying unit 4 reaches a predetermined temperature, the CPU 13 performs the control of the electric connection to the heater 52 or the control of the temperature of the heater 52 so that the temperature of the drying unit 4 is maintained at a predetermined temperature (75° C.), and S108 (restarting of printing) is performed.

In the embodiment, since the recording head 34 is recovered to the normal state by the third maintenance work, the recording head 34 is determined to be not recovered to the normal state in the first AID inspection (S105) (determination is N in S105), and through S111 (counting up of the count value n), S112 (evaluation of the count value n), and S114 (setting of a condition of a new maintenance work), the second maintenance work in S201 is performed.

Subsequently, in S105, the CPU 13 performs the second AID inspection, and determinates whether or not the recording head 34 is recovered to the normal state by the second maintenance work in S104.

In the embodiment, since the recording head 34 is recovered to the normal state by the third maintenance work, the recording head 34 is determined to be not recovered to the normal state in the second AID inspection (S105) (determination is N in S105), and through S111 (counting up of the count value n), S112 (evaluation of the count value n), and S114 (setting of the condition of the new maintenance work), the third maintenance work in S201 is performed.

Subsequently, in S105, the CPU 13 performs the third AID inspection, and determinates whether or not the recording head 34 is recovered to the normal state by the third maintenance work. Also, the recording head 34 is revered to the normal state in the third AID inspection (S105) (determination is N in S105), and through S107 (confirmation of the temperature of the drying unit 4), the printing on the medium 7 restarts in S108.

As illustrated in FIG. 7, after S101 is performed (after the starting of the interruption work), the temperature of the drying unit 4 is decreased, and the temperature of the drying unit 4 is increased during the first maintenance work. That is, in a case in which determination is Y by the first AID inspection of S105, the printing on the medium 7 is possible to immediately restart, and the temperature of the drying unit 4 reaches 75° C. (predetermined temperature) by performing the control of electric connection to the heater 52 or the temperature control of the heater 52 of the drying unit 4 after the first AID inspection of S105 is finished.

In the embodiment, in the first AID inspection, since the recording head 34 is determined not to be recovered to the normal state, in a case in which the first AID inspection is finished and the second maintenance work is performed, the temperature of the drying unit 4 is decreased, and the temperature of the drying unit 4 is increased during the second maintenance work.

That is, in a case in which determination is Y by the second AID inspection, the printing on the medium 7 is possible to immediately restart, and, the temperature of the drying unit 4 reaches 75° C. (predetermined temperature) by performing the control of electric connection to the heater 52 or the temperature control of the heater 52 of the drying unit 4 after the second AID inspection is finished.

In the embodiment, even in the second AID inspection, since the recording head 34 is determined not to be recovered to the normal state, in a case in which the second AID inspection is finished and the third maintenance work is performed, the temperature of the drying unit 4 is decreased, and the temperature of the drying unit 4 is increased during the third maintenance work.

That is, in a case in which determination is Y by the third AID inspection of S105, the printing on the medium 7 is possible to immediately restart, and the temperature of the drying unit 4 reaches 75° C. (predetermined temperature) by performing the control of electric connection to the heater 52 or the temperature control of the heater 52 of the drying unit 4 after the third AID inspection is finished. In the embodiment, in the third AID inspection of S105, since the recording head 34 is determined to be recovered to the normal state, the temperature of the drying unit 4 reaches 75° C. (predetermined temperature) at a time when the third AID inspection of S105 is finished, and the temperature of the drying unit 4 is maintained at 75° C. (predetermined temperature).

Also, when the temperature of the drying unit 4 is maintained at 75° C. (predetermined temperature), the printing on the medium 7 restarts.

As described above, since "after the interruption work" in this disclosure corresponds to after determination is Y in S105 (AID inspection), "at the time of finishing the determination work" in this disclosure corresponds to when determination is Y in S105 (AID inspection), in the second mode, the temperature of the drying unit 4 is increased during the maintenance work, and the control of the electric connection to the heater 52 or the control of the temperature of the heater 52 is performed so that the temperature of the drying unit 4 becomes a temperature (predetermined temperature (75° C.)) before the maintenance work when determination is Y in the AID inspection (S105) (at the time of finishing the determination work).

For example, in a case in which the recording head 34 is recovered to the normal state by only the first maintenance work, in the second mode, after S101 is performed (after the starting of the interruption work), the temperature of the drying unit 4 is decreased by performing the control of electric connection to the heater 52 or the temperature control of the heater 52, and the temperature of the drying unit 4 is increased by performing the control of electric connection to the heater 52 or the temperature control of the heater 52 of the drying unit 4 during the first maintenance work.

That is, in the second mode, in a case in which the printing is temporarily stopped and the predetermined first maintenance work is performed, the temperature of the drying unit 4 is decreased by performing the control of electric connection to the heater 52 or the temperature control of the heater 52 after S101 is performed (after the starting of the interruption work), and the temperature of the drying unit 4 is increased by performing the control of electric connection to the heater 52 or the temperature control of the heater 52 of the drying unit 4 during the first maintenance work.

Further, in the second mode, the control of electric connection to the heater 52 or the temperature control of the heater 52 is performed so that the temperature of the drying unit 4 becomes a temperature (75° C.) before starting of the first maintenance work, when the determination is Y in the AID inspection (S105) (at the time of finishing the determination work).

For example, in a case in which the recording head 34 is less likely to be recovered to the normal state by only the first maintenance work, and a new maintenance work (first maintenance work or second maintenance work) is further performed continuing the first maintenance work, in the second mode, after the first AID inspection, the temperature of the drying unit 4 is decreased by performing the control of electric connection to the heater 52 or the temperature control of the heater 52, and the temperature of the drying unit 4 is increased by performing the control of electric connection to the heater 52 or the temperature control of the heater 52 of the drying unit 4 during the new maintenance work.

Further, in the second mode, new maintenance works (second maintenance work and third the third maintenance work) are repeatedly performed a plurality of times, the temperature of the drying unit 4 is increased by performing the control of electric connection to the heater 52 or the temperature control of the heater 52 of the drying unit 4 is performed so that the temperature of the drying unit 4 becomes 75° C. (predetermined temperature) at the time of finishing the last new maintenance work (third maintenance work), or when determination is Y in the last AID inspection (S105).

Also, in the second mode, it is possible to exhibit following effects.

1) In a case in which the maintenance work is performed, since the temperature of the drying unit 4 is lower than 75° C. (predetermined temperature), compared to a case in which the temperature of the drying unit 4 is 75° C. (predetermined temperature), the thermal damage such as wrinkles is not easily generated in the medium 7.

2) In the second mode, it is expected that the recording head 34 is recovered to the normal state by the maintenance work, since the temperature of the drying unit 4 is increased faster than that of the first mode, and the temperature of the drying unit 4 reaches 75° C. (predetermined temperature) faster than that of the first mode, the printing on the medium 7 immediately restarts faster than that of the first mode, and thereby making it possible to reduce a loss generated from the maintenance work to restarting the printing.

Further, in the first mode, the temperature of the drying unit 4 is increased after recovering of the recording head 34 to the normal state by the maintenance work is recognized, and in the second mode, the temperature of the drying unit 4 is increased during the maintenance work. Thus, in the first mode, compared to the second mode, the temperature of the drying unit 4 is lowered in a case in which the maintenance work is performed, and the thermal damage such as wrinkles is not easily generated in the medium 7.

Therefore, in the first mode, the thermal damage is not easily generated in the medium 7 compared to the second mode, and thus the first mode is suitable for the medium 7 in which the thermal damage is easily generated.

As described above, when the drying unit 4 performs the heating process, a thermal damage is easily generated in the medium 7 because the medium 7 is configured with the printing member 7*a* (resin) which thermally expands and the supporting member 7*b* (paper) which thermally shrinks. For example, even in a case in which the medium 7 is configured with a printing member 7*a* (paper) which thermally shrinks and a supporting member 7*b* (resin) which thermally expands, the thermal damage is easily generated in the medium 7.

In a case in which the thermal damage is easily generated in the medium 7, it is preferable that the first mode be selected.

Meanwhile, in the second mode, compared to the first mode, the temperature of the drying unit 4 becomes high in a case in which the maintenance work is performed, and the thermal damage such as wrinkles is easily generated in the medium 7, but the temperature of the drying unit 4 quickly reaches 75° C. (predetermined temperature), and thus there is an advantage that the printing on the medium 7 is possible to quickly restart.

For example, in a case in which the printing member 7*a* and the supporting member 7*b* are made of a material (resin) which is likely to thermally expand, a thermal damage is easily generated in the medium 7. Further, in a case in which the printing member 7*a* and the supporting member 7*b* are made of a material (paper) which is likely to thermally shrink, the thermal damage is not easily generated in the medium 7.

In a case in which the thermal damage is not easily generated in the medium 7, the second mode can be applied thereto, the second mode is preferably selected.

The printing apparatus 100 according to the embodiment includes a configuration in which it is determined that the first mode or the second mode can be selected depending on the types of the medium 7. That is, in the printing apparatus 100, a worker can select performing the first mode or the second mode depending on the types of the medium 7.

As described above, since the temperature of the drying unit 4 in a case in which the maintenance work is performed is low in the first mode, the first mode is preferably applied to the medium 7 in which a thermal damage is easily generated. The second mode has an advantage that the printing on the medium 7 is enable to quickly restart, and thus is preferably applied to the medium 7 in which a thermal damage is not easily generated.

That is, it is preferable that the first mode or the second mode be selected depending on the types of the medium 7.

Further, the printing apparatus 100 according to the embodiment includes a configuration in which the temperature (standby temperature) at which the drying unit 4 is maintained after the decrease of the temperature can be varied depending on the types of the medium 7. That is, in the printing apparatus 100, the worker causes the temperature of the drying unit 4 to be decreased, and can change the temperature (standby temperature) at which the drying unit 4 is maintained after the decrease of the temperature.

Moreover, with respect to the medium 7 in which a heat resistance property of the medium 7 is weak and the thermal damage is generated in a case in which the standby temperature is 50° C., it is preferable that the standby temperature be further decreased than 50° C., and the first mode is applied. That is, in the first mode, depending on the types of the medium 7 (depending on the heat resistance property of the medium 7), the temperature (standby temperature) at which the drying unit 4 after the decrease of the temperature is maintained is preferably changed.

Further, in the printing method of the printing apparatus 100 according to the embodiment, in a case in which the printing is temporarily stopped, and the predetermined maintenance work is performed, the temperature of the drying unit 4 is increased and the printing restarts, by either of the first mode in which the temperature of the drying unit 4 is decreased by performing the control of the electric connection to the heater 52 or the control of the temperature of the heater 52 of the drying unit 4 after S101 is performed (after the interruption work starts), and the temperature of the drying unit 4 is increased by performing the control of the electric connection to the heater 52 or the control of the temperature of the heater 52 after S104 (maintenance work), or the second mode in which the temperature of the drying unit 4 is decreased by performing the control of the electric connection to the heater 52 or the control of the temperature of the heater 52 after S101 is performed (after the interruption work starts), and the temperature of the drying unit 4 is increased by performing the control of the electric connection to the heater 52 or the control of the temperature of the heater 52 of the drying unit 4 during S104 (maintenance work).

When the printing restarts by the first mode, the temperature of the drying unit 4 is decreased during the maintenance work, and a defect that the medium 7 is excessively heated during the maintenance work (the thermal damage of the medium 7) does not easily occur. Further, when the printing restarts by the second mode, compared to a case in which the printing restarts by the first mode, it is possible to quickly return the temperature of the drying unit 4 after the maintenance work to a predetermined temperature at which printing is possible, and thus the printing is enable to quickly restart.

The invention is not limited to the embodiments described above, and can be appropriately modified within a range not contrary to a gist or an idea being read from claims and the entire specification, and various modification examples other than the above-described embodiments are conceivable.

MODIFICATION EXAMPLE 1

In a case in which the maintenance work is performed, the temperature of the platen 30 may be decreased or increased in the same manner as that of the temperature of the drying unit 4.

In detail, the printing apparatus according to this modification example may include a configuration in which, in which in a case where printing is temporarily stopped, and the maintenance work is performed, the temperature of the platen 30 is decreased by performing a control of electric connection to the heater 38 or a temperature control of the heater 38 after S101 is performed (after the interruption work starts), and further, the temperature of the platen 30 is increased by performing the control of electric connection to the heater 38 or the temperature control of the heater 38 after the maintenance work.

Further, the printing apparatus 100 according to this modification example may include a configuration in which, in a case in which in a case in which printing is temporarily stopped, and the maintenance work is performed, the temperature of the platen 30 is decreased by performing the control of electric connection to the heater 38 or the temperature control of the heater 38 after S101 is performed (after the interruption work starts), and further, the temperature of the platen 30 is increased by performing the control of electric connection to the heater 38 or the temperature control of the heater 38 during the maintenance work.

With such a configuration, in a case in which the printing is temporarily stopped, and S104 (maintenance work) is performed, it is possible to further reduce an adverse influence of heat with respect to the medium 7.

MODIFICATION EXAMPLE 2

In the embodiments described above, the printing apparatus 100 including the recording head 34 as a liquid ejecting head is described as an example of an electronic device, but the invention can be applied to other electronic devices. For example, the invention can also be applied to a color material ejecting apparatus including a color material ejecting head being used for manufacturing a color filter such as a liquid crystal display, an electrode material ejecting apparatus including an electrode material ejecting head being used for forming an electrode such as an organic electro luminescence (EL) display or a surface emitting display (FED), and a bioorganic ejecting apparatus including a bioorganic ejecting head being used for manufacturing a biochip (biochemical element).

This application claims priority under 35 U.S.C. § 119 to Japanese Patent Application No. 2017-026670, filed Feb. 16, 2017. The entire disclosure of Japanese Patent Application No. 2017-026670 is hereby incorporated herein by reference.

What is claimed is:

1. A printing apparatus comprising:

a drying unit that dries a medium on which ink is applied, wherein, in a case in which printing is temporarily stopped and a predetermined interruption work is performed, the printing apparatus has a first mode in which a temperature of the drying unit is decreased by performing a control of electric connection to a heater of the drying unit or a temperature control of the heater after starting the interruption work, and the temperature of the drying unit is increased by performing the control of electric connection to the heater or the temperature control of the heater after the interruption work, and a second mode in which the temperature of the drying unit is decreased by performing the control of electric connection to the heater or the temperature control of the heater after the starting of the interruption work, and the temperature of the drying unit is increased by performing the control of electric connection to the heater or the temperature control of the heater during the interruption work.

2. The printing apparatus according to claim 1, wherein the printing apparatus has a determination work for determining whether or not to perform a first interruption work which is the same as the interruption work or a second interruption work which is different from the interruption work after the interruption work.

3. The printing apparatus according to claim 2, wherein, in the second mode, the control of electric connection to the heater or the temperature control of the heater is performed so that the temperature of the drying unit becomes a temperature before the starting of the interruption work when the determination work is finished.

4. The printing apparatus according to claim 2, wherein, in the first mode, the control of electric connection to the heater or the temperature control of the heater is performed so that the temperature of the drying unit reaches a standby temperature which is lower than a temperature at the time of starting the interruption work after starting the interruption work, and the control of electric connection to the heater or the temperature control of the heater is performed so that the standby temperature is maintained until the determination work is finished after the temperature reaches the standby temperature.

5. The printing apparatus according to claim 4, wherein the standby temperature is varied depending on the types of the medium.

6. The printing apparatus according to claim 4, wherein, in a case in which the first interruption work or the second interruption work is further performed as a result of the determination work, in the first mode, the control of electric connection to the heater or the temperature control of the heater is performed so that the standby temperature is maintained even during the first interruption work or the second interruption work, and the temperature of the drying unit is increased by performing the control of electric connection to the heater or the temperature control of the heater after the first interruption work or the second interruption work is finished.

7. The printing apparatus according to claim 6, wherein the first interruption work or the second interruption work is repeatedly performed a plurality of times, and the temperature of the drying unit is increased by performing the control of electric connection to the heater or the temperature control of the heater after the last first interruption work or the last second interruption work is finished.

8. The printing apparatus according to claim 2, wherein, in a case in which the first interruption work or the second interruption work is further performed as a result of the determination work, in the second mode, the temperature of the drying unit is decreased by performing a control of electric connection to the heater or a temperature control of the heater after the determination work, and the temperature of the drying unit is increased by performing a control of electric connection to the heater or a temperature control of the heater during the first interruption work or the second interruption work.

9. The printing apparatus according to claim 8, wherein the first interruption work or the second interruption work is repeatedly performed a plurality of times, and the control of electric connection to the heater or the temperature control of the heater is performed so that the temperature of the drying unit becomes a predetermined temperature when the last first interruption work is finished or the last second interruption work is finished.

10. The printing apparatus according to claim 1, further comprising:

a receiving unit that receives selection of the first mode or selection of the second mode.

11. The printing apparatus according to claim 1, wherein whether or not the first mode is selected or the second mode is selected is determined depending on the types of the medium.

12. A printing method of a printing apparatus which includes a drying unit that dries a medium on which ink is applied, the method comprising:

in a case in which printing is temporarily stopped and a predetermined interruption work is performed, the predetermined interruption work including a flushing process and a wiping process of an ejection head of the printing apparatus, increasing a temperature of the drying unit that dries a medium on which ink is applied and restarting the printing by either of a first mode, in which a temperature of the drying unit is decreased by performing a control of electric connection to a heater of the drying unit or a temperature control of the heater after starting the interruption work and the temperature of the drying unit is increased by performing the control of electric connection to the heater or the temperature control of the heater after the interruption work, or a second mode in which the temperature of the drying unit is decreased by performing the control of electric connection to the heater or the temperature control of the heater after the starting of the interruption work, and the temperature of the drying unit is increased by performing the control of electric connection to the heater or the temperature control of the heater during the interruption work.

* * * * *